US008747246B2

(12) United States Patent
Swartz et al.

(10) Patent No.: US 8,747,246 B2
(45) Date of Patent: Jun. 10, 2014

(54) METHODS, APPARATUS, AND SYSTEMS TO CUSTOM FIT GOLF CLUBS

(71) Applicant: Karsten Manufacturing Corporation, Phoenix, AZ (US)

(72) Inventors: Gregory J. Swartz, Anthem, AZ (US); Roger J. Cottam, Mesa, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 13/869,557

(22) Filed: Apr. 24, 2013

(65) Prior Publication Data

US 2013/0237337 A1 Sep. 12, 2013

Related U.S. Application Data

(63) Continuation of application No. 12/358,616, filed on Jan. 23, 2009, now Pat. No. 8,444,509, and a continuation-in-part of application No. 12/051,501, filed on Mar. 19, 2008, now Pat. No. 8,371,962.

(60) Provisional application No. 61/144,669, filed on Jan. 14, 2009, provisional application No. 60/976,077, filed on Sep. 28, 2007.

(51) Int. Cl.
*A63B 57/00* (2006.01)

(52) U.S. Cl.
USPC ..... 473/278; 473/221; 473/409

(58) Field of Classification Search
None
See application file for complete search history.

(56) References Cited

U.S. PATENT DOCUMENTS

| | | | | |
|---|---|---|---|---|
| 4,059,270 | A | 11/1977 | Sayers | |
| 5,591,091 | A | 1/1997 | Hackman | |
| 5,846,139 | A | 12/1998 | Bair et al. | |
| 5,879,241 | A | 3/1999 | Cook et al. | |
| 5,911,636 | A | 6/1999 | Schmoll | |
| 5,951,410 | A | 9/1999 | Butler et al. | |
| 6,083,123 | A | 7/2000 | Wood | |
| 6,089,989 | A * | 7/2000 | Sutcliffe | 473/225 |
| 6,328,660 | B1 | 12/2001 | Bunn | |
| 6,379,258 | B1 | 4/2002 | To | |
| 6,431,990 | B1 | 8/2002 | Manwaring | |
| 6,565,449 | B2 | 5/2003 | Buhler | |
| 6,672,978 | B1 | 1/2004 | Morgan et al. | |
| 6,719,648 | B1 | 4/2004 | Smith | |
| 6,929,558 | B2 | 8/2005 | Manwaring et al. | |
| 6,966,843 | B2 | 11/2005 | Rankin et al. | |

(Continued)

FOREIGN PATENT DOCUMENTS

| | | |
|---|---|---|
| JP | H09117534 | 5/1997 |
| JP | H09308710 | 12/1997 |

(Continued)

OTHER PUBLICATIONS

John K. Solheim, et al., "Methods, Apparatus, and Systems to Custom Fit Golf Clubs," U.S. Appl. No. 12/118,378, filed May 9, 2008.

(Continued)

*Primary Examiner* — Melba Bumgarner
*Assistant Examiner* — George Howarah

(57) ABSTRACT

Embodiments of methods, apparatus, and systems to custom fit golf clubs are generally described herein. Other embodiments may be described and claimed.

2 Claims, 12 Drawing Sheets

(56) References Cited

U.S. PATENT DOCUMENTS

| | | | | |
|---|---|---|---|---|
| 7,041,014 | B2 | 5/2006 | Wright et al. | |
| 7,056,225 | B1 | 6/2006 | Pipkin | |
| 7,147,570 | B2 | 12/2006 | Toulon et al. | |
| 7,153,215 | B2 | 12/2006 | Peterson et al. | |
| 7,166,035 | B2 | 1/2007 | Voges et al. | |
| 7,273,427 | B2 | 9/2007 | Inoue et al. | |
| 7,967,695 | B2 | 6/2011 | Voges et al. | |
| 2002/0072429 | A1 | 6/2002 | Rankin et al. | |
| 2002/0098898 | A1 | 7/2002 | Manwaring | |
| 2002/0155896 | A1 | 10/2002 | Gobush et al. | |
| 2003/0008731 | A1 | 1/2003 | Anderson et al. | |
| 2003/0027655 | A1 | 2/2003 | Lutz et al. | |
| 2003/0040380 | A1 | 2/2003 | Wright et al. | |
| 2003/0054327 | A1 | 3/2003 | Evensen | |
| 2003/0119595 | A1 | 6/2003 | Manwaring et al. | |
| 2003/0190972 | A1* | 10/2003 | Townsend, II | 473/278 |
| 2003/0191547 | A1 | 10/2003 | Morse | |
| 2004/0006442 | A1 | 1/2004 | Boehm | |
| 2004/0023725 | A1 | 2/2004 | Llewellyn et al. | |
| 2004/0127303 | A1 | 7/2004 | Teraoka | |
| 2004/0204257 | A1 | 10/2004 | Boscha et al. | |
| 2004/0259653 | A1 | 12/2004 | Gobush et al. | |
| 2005/0070366 | A1 | 3/2005 | Manwaring et al. | |
| 2005/0085309 | A1 | 4/2005 | McGann et al. | |
| 2005/0159231 | A1 | 7/2005 | Gobush | |
| 2005/0181884 | A1 | 8/2005 | Beach et al. | |
| 2005/0215336 | A1 | 9/2005 | Ueda et al. | |
| 2005/0215340 | A1 | 9/2005 | Stites et al. | |
| 2005/0268704 | A1 | 12/2005 | Bissonnette et al. | |
| 2005/0272512 | A1 | 12/2005 | Bissonnette et al. | |
| 2005/0272513 | A1 | 12/2005 | Bissonnette et al. | |
| 2005/0272516 | A1 | 12/2005 | Gobush | |
| 2005/0277483 | A1 | 12/2005 | Peterson et al. | |
| 2005/0282645 | A1 | 12/2005 | Bissonnette et al. | |
| 2006/0014588 | A1 | 1/2006 | Page | |
| 2006/0166757 | A1 | 7/2006 | Butler, Jr. et al. | |
| 2006/0211510 | A1 | 9/2006 | Ashida et al. | |
| 2007/0049393 | A1 | 3/2007 | Gobush | |
| 2007/0135225 | A1 | 6/2007 | Nieminen et al. | |
| 2007/0167247 | A1 | 7/2007 | Lindsay | |
| 2007/0167249 | A1 | 7/2007 | Voges et al. | |
| 2007/0238539 | A1* | 10/2007 | Dawe et al. | 473/131 |
| 2007/0265105 | A1 | 11/2007 | Barton et al. | |
| 2007/0298896 | A1 | 12/2007 | Nusbaum et al. | |
| 2008/0020867 | A1 | 1/2008 | Manwaring | |
| 2008/0026869 | A1 | 1/2008 | Galloway | |
| 2008/0039222 | A1 | 2/2008 | Kiraly | |
| 2008/0132361 | A1 | 6/2008 | Barber | |
| 2008/0182685 | A1 | 7/2008 | Marty et al. | |
| 2008/0188353 | A1 | 8/2008 | Vitolo et al. | |
| 2009/0005188 | A1 | 1/2009 | Iwatsubo et al. | |
| 2009/0017930 | A1 | 1/2009 | Burnett et al. | |
| 2009/0088275 | A1 | 4/2009 | Solheim et al. | |
| 2009/0088276 | A1 | 4/2009 | Solheim et al. | |
| 2009/0131189 | A1 | 5/2009 | Swartz et al. | |
| 2009/0131193 | A1 | 5/2009 | Swartz et al. | |
| 2009/0215549 | A1 | 8/2009 | Burnett et al. | |
| 2010/0151956 | A1 | 6/2010 | Swartz et al. | |
| 2011/0028247 | A1 | 2/2011 | Ligotti et al. | |
| 2011/0039632 | A1 | 2/2011 | Bennett et al. | |

FOREIGN PATENT DOCUMENTS

| | | |
|---|---|---|
| JP | 2001145718 | 5/2001 |
| JP | 2001511045 | 8/2001 |
| JP | 2002119621 | 4/2002 |
| JP | 2003042716 | 2/2003 |
| JP | 2003199859 | 7/2003 |
| JP | 2003102892 | 8/2003 |
| JP | 2004135908 | 5/2004 |
| JP | 2006031430 | 2/2006 |
| JP | 2006247023 | 9/2006 |
| WO | WO02081039 | 10/2002 |
| WO | WO2005053798 | 6/2005 |
| WO | WO2007095081 | 8/2007 |

OTHER PUBLICATIONS

John K. Solheim, et al., "Methods, Apparatus, and Systems to Custom Fit Golf Clubs," U.S. Appl. No. 12/051,501, filed Mar. 19, 2008.

Gregory J. Swartz, et al., "Methods, Apparatus, and Systems to Custom Fit Golf Clubs," U.S. Appl. No. 12/358,616, filed Jan. 23, 2009.

Gregory J. Swartz, et al., "Methods, Apparatus, and Systems to Custom Fit Golf Clubs," U.S. Appl. No. 12/358,463, filed Jan. 23, 2009.

Gardiner Golf Simulator Systems, "Fusing Technology With the Art of Golf," May 23, 3006, http://web.archive.org/web/20060523042206/http://www.golf-simulators.com/physics.htm, pp. 1-13. May 23, 2006.

Gregory J. Swartz, et al., "Methods, Apparatus, and Systems to Custom Fit Golf Clubs," U.S. Appl. No. 12/694,121, filed Jan. 26, 2010.

* cited by examiner

1100

| Type | Club | Model | Carry Distance | Total Distance | Gap Distance |
|---|---|---|---|---|---|
| Measured | Lob wedge | A | 81 | 81 | - |
| Calculated | Sand wedge | A | 90 | 90 | 9 |
| Calculated | Pitching wedge | A | 110 | 111 | 20 |
| Calculated | 9-iron | B | 120 | 122 | 10 |
| Calculated | 8-iron | B | 130 | 135 | 10 |
| Calculated | 7-iron | B | 140 | 147 | 10 |
| Measured | 6-iron | B | 150 | 159 | 10 |
| Calculated | 5-iron | B | 160 | 170 | 10 |
| Calculated | 4-iron | B | 165 | 180 | 5 |
| Calculated | Hybrid 22° | C | 170 | 180 | 5 |
| Calculated | Hybrid 18° | C | 180 | 195 | 10 |
| Measured | Hybrid 15° | C | 185 | 205 | 5 |
| Calculated | 5-fairway wood | C | 190 | 205 | 5 |
| Calculated | 3-fairway wood | C | 210 | 230 | 20 |
| Measured | Driver | D | 240 | 260 | 30 |

1110
1120
1130
1140

FIG. 11

METHODS, APPARATUS, AND SYSTEMS TO CUSTOM FIT GOLF CLUBS

CROSS REFERENCE TO RELATED APPLICATIONS

This application is a continuation of U.S. patent application Ser. No. 12/358,616, filed on Jan. 23, 2009, which is a non-provisional patent application claiming priority from U.S. Provisional Patent Application No. 61/144,669, filed Jan. 14, 2009, and which is a Continuation-In-Part patent application claiming priority to U.S. patent application Ser. No. 12/051,501, filed Mar. 19, 2008, now U.S. Pat. No. 8,371,962, which claims priority to U.S. Provisional Application 60/976,077, filed Sep. 28, 2007.

TECHNICAL FIELD

The present disclosure relates generally to sport equipment, and more particularly, to methods, apparatus, and systems to custom fit golf clubs.

BACKGROUND

To ensure an individual is playing with appropriate equipment, the individual may be custom fitted for golf clubs. In one example, the individual may be fitted for golf clubs (e.g., iron-type golf clubs) according to the custom fitting process developed by PING®, Inc. to match the individual with a set of golf clubs. As part of the custom fitting process developed PING®, Inc., for example, a color code system may be used to fit individuals of varying physical characteristics (e.g., height, wrist-to-floor distance, hand dimensions, etc.), swing tendencies (e.g., hook, slice, pull, push, etc.), and ball flight preferences (e.g., draw, fade, etc.) with iron-type golf clubs. With custom-fitted golf clubs, individuals may play golf to the best of their abilities.

BRIEF DESCRIPTION OF THE DRAWINGS

FIG. 11 depicts a visual diagram representation of another example display of the example fitting system of FIG. 1.

DESCRIPTION

In general, methods, apparatus, systems, and articles of manufacture to custom fit golf clubs are described herein. The methods, apparatus, systems, and articles of manufacture described herein are not limited in this regard.

Figure 1:
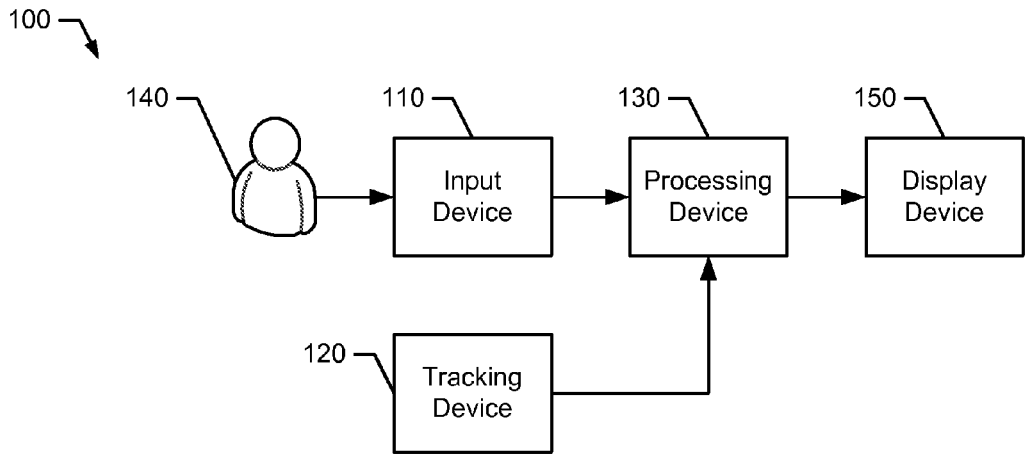
FIG. 1 is a block diagram representation of an example fitting system according to an embodiment of the methods, apparatus, systems, and articles of manufacture described herein.
Figure 2:
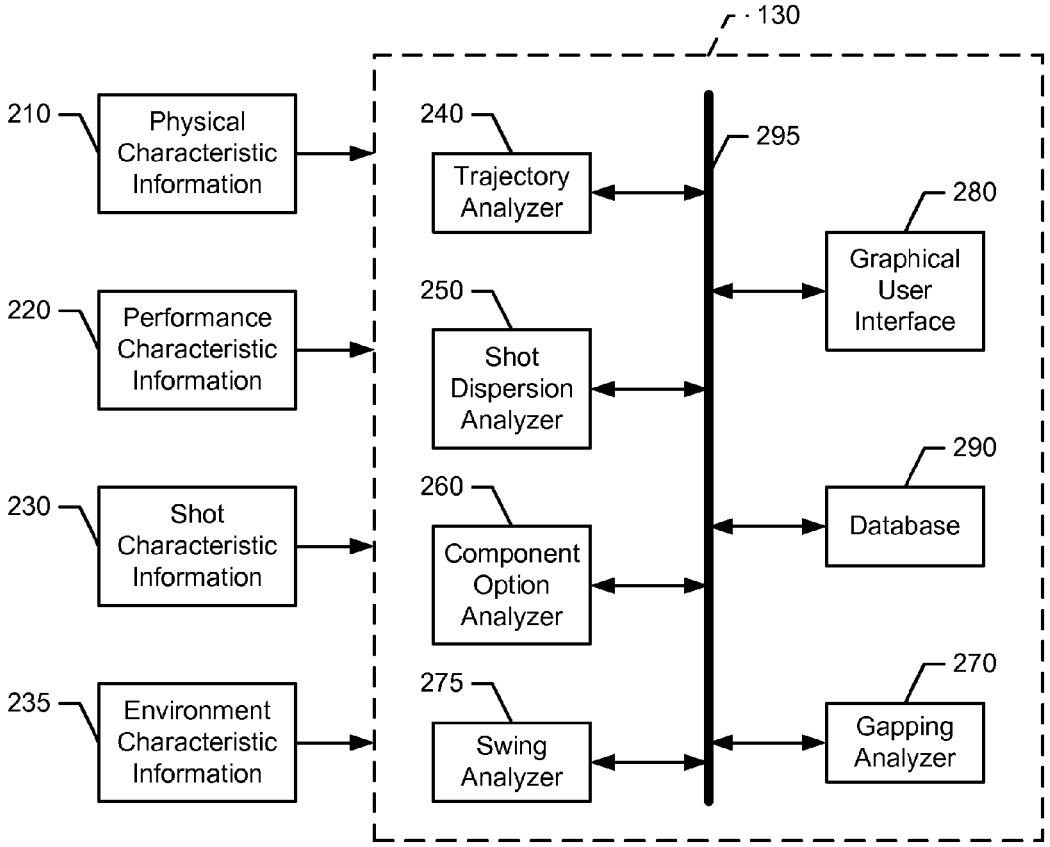
FIG. 2 depicts a block diagram representation of an example processing device of the example fitting system of FIG. 1.

In the example of FIGS. 1 and 2, a fitting system 100 may include an input device 110, a tracking device 120 (e.g., a ball launch monitor and/or a ball flight monitor), and a processing device 130. The input device 110 and the tracking device 120 may be coupled to the processing device 130 via a wireless connection and/or a wired connection. The fitting system 100 may be used to fit various golf clubs such as driver-type golf clubs, fairway wood-type golf clubs, hybrid-type golf clubs, iron-type golf clubs, wedge-type golf clubs, putter-type golf clubs, and/or any other suitable type of golf clubs.

In general, the input device 110 may assist in the interview portion of a custom fitting session. The input device 110 may be coupled to the processing device 130 so that information associated with physical and performance characteristics of an individual 140 being fitted for one or more golf clubs (e.g., physical characteristic information 210 and performance characteristic information 220 of FIG. 2) may be entered into the processing device 130 via the input device 110 (e.g., via one or more wired and/or wireless connections). In one example, the physical characteristic information 210 may include gender (e.g., male or female), age, dominant hand (e.g., left-handed or right-handed), hand dimension(s) (e.g., hand size, longest finger, etc. of dominant hand), height (e.g., head to toe), wrist-to-floor distance, and/or other suitable characteristics. The performance characteristic information 220 may include average carry distance of one or more golf clubs (e.g., average carry distance of a shot by the individual with a driver golf club, a 7-iron golf club, etc.), golf handicap, number of rounds played per a period of time (e.g., month, quarter, year, etc.), golf preferences (e.g., distance, direction, trajectory, shot pattern, etc.), and/or other suitable characteristics. The input device 110 may permit an individual to enter data and commands into the processing device 130. For example, the input device 110 may be implemented by a keyboard, a mouse, a touch-sensitive display, a track pad, a track ball, a voice recognition system, and/or other suitable human interface device (HID). The methods, apparatus, systems, and articles of manufacture described herein are not limited in this regard.

The tracking device 120 may measure characteristics associated with a shot of a golf ball with a particular golf club (e.g., shot characteristic information 230 of FIG. 2). To provide the processing device 130 with shot characteristic information 230, the tracking device 120 may be coupled to the processing device 130 via one or more wired and/or wireless connection(s). For example, the shot characteristic information 230 may include speed of the golf club during a shot, speed of a golf ball in response to impact with the golf club, launch angle of the golf ball in response to impact with the golf club, back spin of the golf ball in response to impact with the golf club, side spin of the golf ball in response to impact with the golf club, smash factor of the golf ball (e.g., the speed of the golf ball divided by the speed of the golf club head), total distance of the shot, bend of the shot (e.g., relative to an initial direction due to side spin), off-center distance of the shot, and/or other suitable shot characteristics. The methods, apparatus, systems, and articles of manufacture described herein are not limited in this regard.

The processing device 130 may include a trajectory analyzer 240, a shot dispersion analyzer 250, a component option analyzer 260, a gapping analyzer 270, and a swing analyzer 275. The processing device 130 may also include a graphical user interface 280 and a database 290. The trajectory analyzer 240, the shot dispersion analyzer 250, the component option analyzer 260, the gapping analyzer 270, the swing analyzer 275, the graphical user interface 280, and/or the database 290 may communicate with each other via a bus 295. As described in detail below, the processing device 130 may provide recommendations to custom fit the individual 140 with one or more golf clubs based on the physical characteristic information 210, the performance characteristic information 220, and/or the shot characteristic information 230. In general, the trajectory analyzer 240 may analyze the shot characteristic information 230 to generate a two-dimensional trajectory display (e.g., one shown as 320 of FIG. 5) and a three-dimensional trajectory display (e.g., one shown as 310 of FIG. 4). The shot dispersion analyzer 250 may analyze the shot characteristic information 230 to general a shot dispersion display (e.g., one shown as 330 of FIG. 6). The component option analyzer 260 may analyze the physical characteristic information 210, the performance characteristic information 220, and/or the shot characteristic information 230 to identify an optimal option for one or more components of a golf club. The gapping analyzer 270 may analyze the physical characteristic information 210, the performance characteristic information 220, and/or the shot characteristic information 230 to identify a set of golf clubs with substantially uniform gap distances between two neighboring golf clubs in the set and/or a progression in gap distances in the set (e.g., the gap distance between two neighboring golf clubs in the set may get wider or narrower through the set). The swing analyzer 275 may analyze the shot characteristic information to generate a three-dimensional swing display (e.g., one shown as 1300 of FIGS. 13, 14, and 15). The methods, apparatus, systems, and articles of manufacture described herein are not limited in this regard.

Although FIG. 2 may depict one or more components being separate blocks, two or more components of the processing device 130 may be integrated into a single block. While FIG. 2 may depict particular components integrated within the processing device 130, one or more components may be separate from the processing device 130. In one example, the database 290 may be integrated within a central server (not shown) and the processing device 130 may download information from the database 290 to a local storage device or memory (not shown). The methods, apparatus, systems, and articles of manufacture described herein are not limited in this regard.

Figure 3:
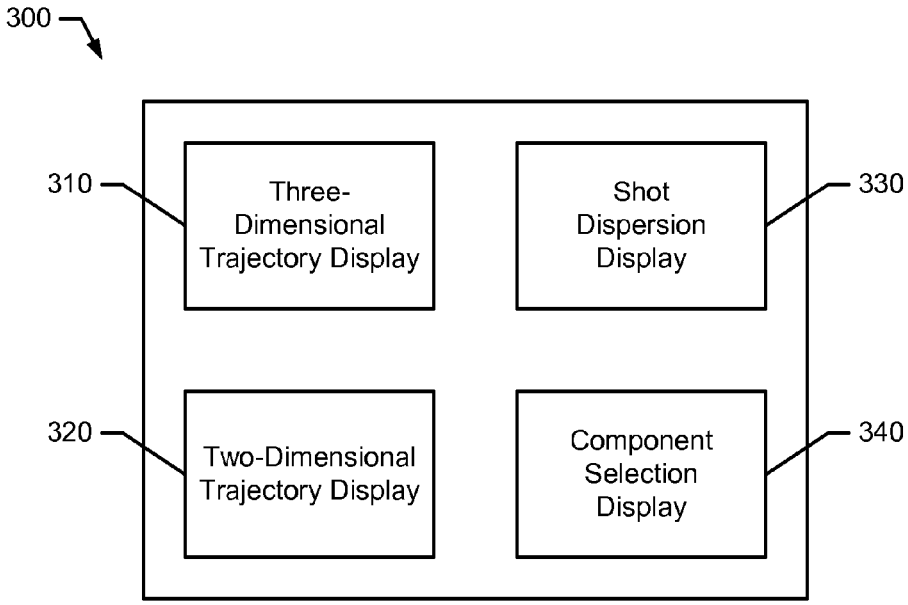
FIG. 3 depicts a visual diagram representation of an example display of the example fitting system of FIG. 1.

Turning to FIG. 3, for example, the graphical user interface 280 may generate a plurality of displays 300, generally shown as 310, 320, 330, and 340, simultaneously or concurrently. For example, the plurality of displays 300 may include a three-dimensional trajectory display 310, a two-dimensional trajectory display 320, a shot dispersion display 330, and a component option display 340. In general, the plurality of displays 300 may provide virtual depictions and/or information associated with a custom fitting session for golf clubs. Although FIG. 3 may depict a particular number of displays, the plurality of displays 300 may include more or less displays to provide virtual depictions and/or information associated with a custom fitting session for golf clubs. Further, while FIG. 3 may depict a particular configuration and size for the plurality of displays 300, the graphical user interface 280 may generate the plurality of displays 300 in other suitable configurations, sizes, etc. The methods, apparatus, systems, and articles of manufacture described herein are not limited in this regard.

Figure 4:
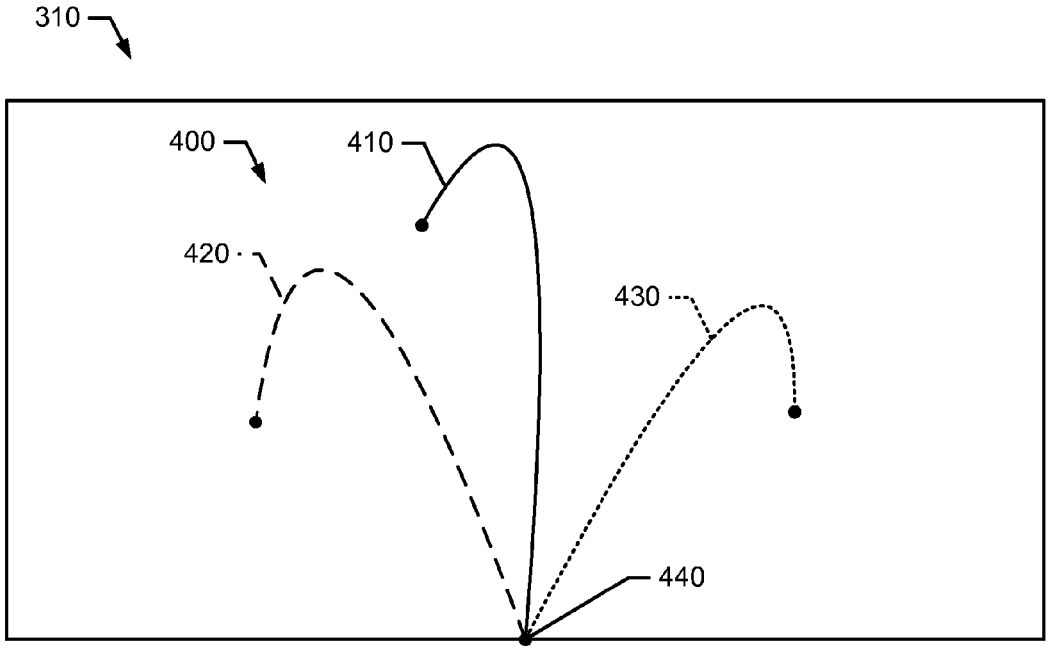
FIG. 4 depicts a visual diagram representation of another example display of the example fitting system of FIG. 1.

In the example of FIG. 4, the three-dimensional trajectory display 310 may generate one or more trajectories 400, generally shown as 410, 420, and 430, associated with a particular golf club from an initial location 440 of a golf ball. That is, the three-dimensional trajectory display 310 may generate the trajectories 400 from the perspective of the individual 140 striking the golf ball and/or someone located proximate to the individual 140. In one example, the three-dimensional trajectory display 310 may generate a first trajectory 410 indicative of a first shot of a golf ball using a particular golf club, a second trajectory 420 indicative of a second shot of a golf ball using the same golf club, and the third trajectory 430 indicative of a third shot of a golf ball using the same golf club.

Although FIG. 4 may depict the first trajectory 410, the second trajectory 420, and the third trajectory 430 in a solid line, a broken line, and a dashed line, respectively, the trajectories 400 may be depicted by colors and/or shading patterns. In one example, the first trajectory 410 may be indicated by a first color (e.g., red), the second trajectory 420 may be indicated by a second color (e.g., blue), and the third trajectory 430 may be indicated by a third color (e.g., yellow). In another example, the first trajectory 410 associated with a first golf club, the second trajectory 420 associated with a second golf club, and the third trajectory 430 may be associated with a third club. The first, second, and third golf clubs may be different from each other in one or more component options as described in detail below (e.g., model, loft, lie, shaft, length, grip, bounce, weight (e.g., swing weight), etc.). In particular, the first trajectory 410 may be indicative of an average of a number of shots associated with the first golf club. The second trajectory 420 may be indicative of an average of a number of shots associated with the second golf club. The third trajectory 430 may be indicative of an average of a number of shots associated with the third golf club. Accordingly, the first trajectory 410 may be depicted by a first color (e.g., red), the second trajectory 420 may be indicated by a second color (e.g., blue), and the third trajectory 430 may be indicated by a third color (e.g., yellow). Although the above examples may describe particular colors, the methods, apparatus, systems, and articles of manufacture described herein may be used in other suitable manners such as shading patterns.

In addition to trajectory information as described above, the three-dimensional trajectory display 310 may also provide environment information such as, for example, altitude, wind speed, humidity, and/or temperature of the location of the custom fitting session. While FIG. 4 and the above examples may depict and describe three trajectories, the methods, apparatus, systems, and articles of manufacture described herein may include more or less trajectories. The methods, apparatus, systems, and articles of manufacture described herein are not limited in this regard.

Figure 5:
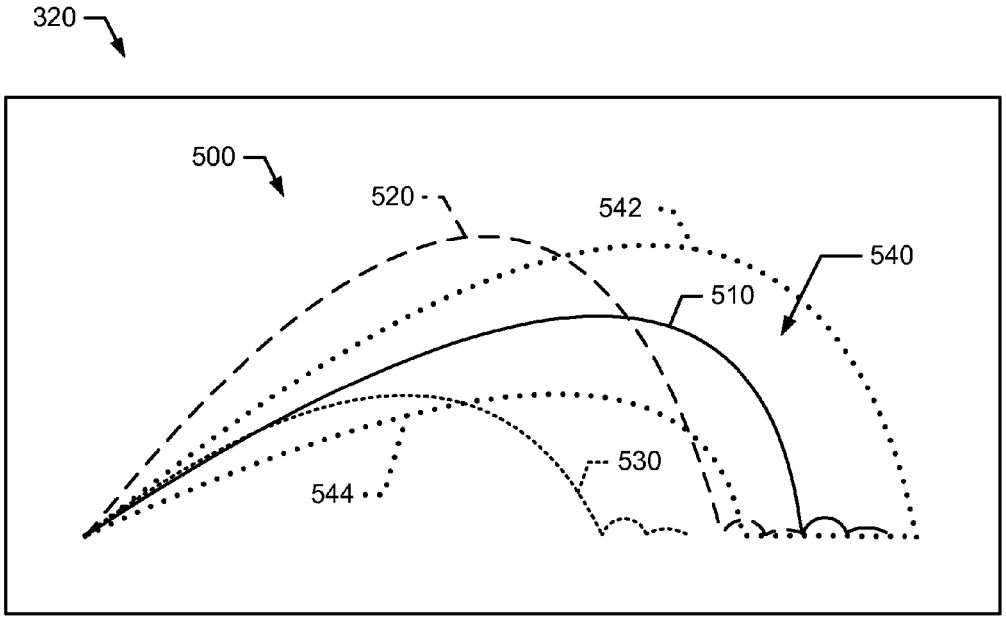
FIG. 5 depicts a visual diagram representation of another example display of the example fitting system of FIG. 1.

Referring to FIG. 5, for example, the two-dimensional trajectory display 320 may generate one or more trajectories 500, generally shown as 510, 520, and 530, relative to an optimal trajectory range 540. Although FIG. 5 may depict the optimal trajectory range 540 with dotted lines, the optimal trajectory range 540 may be depicted as a grayscale band. In particular, the optimal trajectory range 540 may be based on an optimal trajectory and a tolerance. An upper bound 542 and a lower bound 544 may define the tolerance relative to the optimal trajectory. The two-dimensional trajectory display 320 may provide a side view of the trajectories 500. In particular, each of the trajectories 500 may be indicative of a shot with a particular golf club. For example, the first trajectory 510 may be indicative of a trajectory of a first shot with a golf club. The second trajectory 520 may be indicative of a second shot with the same golf club. The third trajectory 530 may be indicative of a third shot with the same golf club. Alternatively, each of the trajectories 500 may be indicative of an average of a number of shots associated with a golf club. For example, the first trajectory 510 may be indicative of an average of a number of shots associated with a first golf club. The second trajectory 520 may be indicative of an average of a number of shots associated with a second golf club (e.g., different from the first golf club). The third trajectory 530 may be indicative of an average of a number of shots associated with a third golf club (e.g., different from the first and second golf clubs). In particular, the first, second, and third golf clubs may be different from each other in one or more component options as described in detail below (e.g., model, loft, lie, shaft, length, grip, bounce, weight, etc.). The optimal trajectory range 540 may be indicative of a target range for an individual with particular swing parameters (e.g., swing speed, ball speed, etc.). Accordingly, the trajectories 500 may be compared to the optimal trajectory range 540.

In addition to the trajectory information described above, the two-dimensional trajectory display 320 may also provide shot information associated with each shot such as, for example, club speed, ball speed, smash factor, launch angle, back spin, side spin, vertical landing angle, offline distance, and carry distance. Further, the two-dimensional trajectory display 320 may expand or hide the shot information associated with a set of shots. The methods, apparatus, systems, and articles of manufacture described herein are not limited in this regard.

Figure 6:
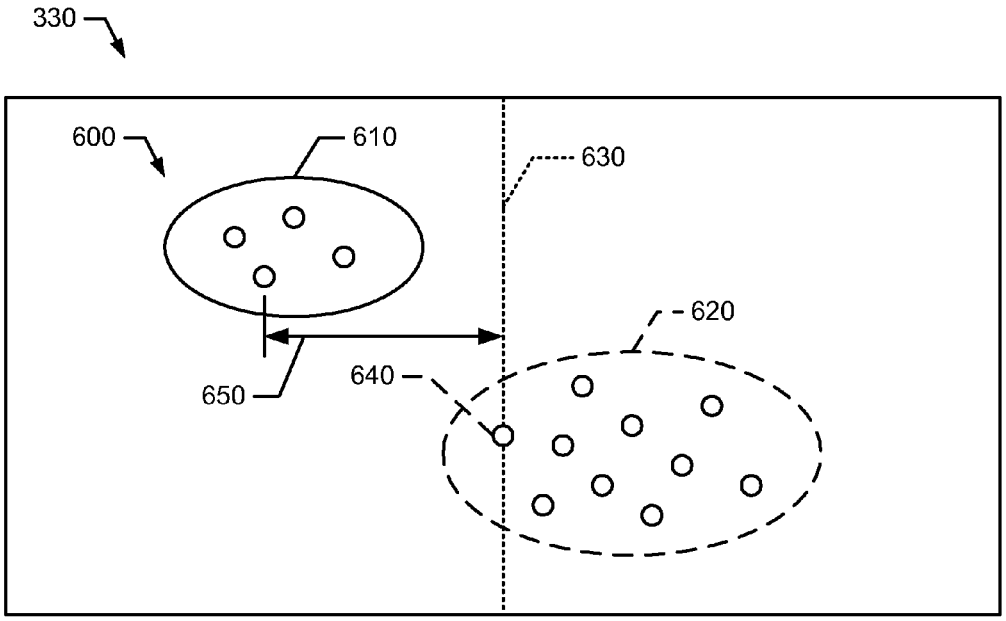
FIG. 6 depicts a visual diagram representation of another example display of the example fitting system of FIG. 1.

Turning to FIG. 6, for example, the shot dispersion display 330 may generate one or more perimeters 600 associated with shot dispersions, generally shown as 610 and 620. Each of the perimeters 600 may be indicative of two or more shots taken with a particular golf club (e.g., visual measures of dispersion). Further, each perimeter may encompass a particular percentage of shots within an area (e.g., 90%) whereas a number of shots may fall outside of that particular perimeter (e.g., 10%).

In one example, the shot dispersion display 330 may generate a first perimeter 610 to inscribe a number of shots associated with a first golf club, and a second perimeter 620 to inscribe a number of shots associated with a second golf club (e.g., different from the first golf club). In particular, the first and second golf clubs may be different from each other in one or more component options as described in detail below (e.g., model, loft, lie, shaft, length, grip, bounce, weight, etc.). The first perimeter 610 may be indicated by a first color (e.g., blue) whereas the second perimeter 620 may be indicated by a second color (e.g., red).

The shot dispersion display 330 may provide a center line 630 to depict a substantially straight shot (e.g., one shown as 640). The center line 630 may be used to determine an offline distance 650 of each shot. A shot to the left of the center line 630 may be a hook shot, a draw shot, or a pull shot whereas a shot to the right of the center line 630 may be a slice shot, a fade shot, or a push shot. For example, shots inscribed by the first perimeter 610 may include hook shots, draw shots, and/or pull shots. Shots inscribed by the second perimeter 620 may include draw shots, slice shots, or fade shots, and/or push shots.

Although FIG. 6 may depict the perimeters having elliptical shapes, the methods, apparatus, systems, and articles of manufacture described herein may include perimeters with other suitable shapes (e.g., circular, rectangular, etc.). The methods, apparatus, systems, and articles of manufacture described herein are not limited in this regard.

The component option display 340 may provide one or more options associated with one or more components of a golf club. In one example, the component option display 340 may depict one or more models of driver-type golf clubs offered by a manufacturer based on the physical characteristic information, the performance characteristic information, and/or shot characteristic information associated with the individual 140. In particular, the component option analyzer 260 may identify a particular model based on swing speed of a golf club and gender of the individual 140 (e.g., model options). Based on the selected model option, the component option analyzer 260 may identify one or more lofts offered by the manufacturer with the selected model option (e.g., loft options). The component option analyzer 260 may also provide one or more type of shafts (e.g., regular, stiff, extra stiff, and soft) associated with the selected model option and the selected loft option (e.g., shaft options). For example, the component option analyzer 260 may identify shaft options based on swing speed of the individual 140. Based on the selected model option, the selected loft option, and the selected shaft option, the component option analyzer 260 may identify one or more lengths associated with the selected model option, the selected loft option, and the selected shaft option. Further, the component option analyzer 260 may identify one or more grips associated with the selected model option, the selected loft option, the selected shaft option, and the selected length option. For example, the component option analyzer 260 may identify a relatively thinner grip so that the individual 140 may generate a less-curved ball flight (e.g., less side spin) if the individual 140 is hitting the golf ball with a slice trajectory but would like to have a straight trajectory. The methods, apparatus, systems, and articles of manufacture described herein are not limited in this regard.

The component option analyzer 260 and/or the component option display 340 may be used in connection with an interchangeable club head and shaft system to identify optimal options of each component of a golf club. By changing to various options of a particular component of a golf club while keeping other components of the golf club unchanged, the component option analyzer 260 may determine the optimal option for that particular component. In one example, various club heads with different lofts of the same model may be used to determine the optimal loft option for an individual.

To provide the individual 140 with a virtual experience during a fitting session, the processing device 130 may also receive environment characteristic information 235 (FIG. 1)

via the input device 110. Accordingly, the processing device 130 (e.g., via the plurality of displays 300) may generate visual representation(s) of the environment in which the individual 140 may play a round of golf. For example, the environment characteristic information 235 may include golf ball conditions (e.g., brand of golf balls (such as premium quality golf balls or non-premium quality golf balls), construction of golf balls (such as two-piece balls, multi-layer balls, etc.), type of golf balls (such as distance balls, spin control balls, etc.), cover of golf balls (such as surlyn cover, urethane cover, etc.), weather conditions (such as temperature, humidity, wind, etc.), golf course conditions (such as altitude of a golf course, fairway surface condition of the golf course, green surface condition of the golf course, etc.) and/or other suitable environment conditions during a round of golf.

In one example, the individual 140 may typically play on golf courses located in relatively high-altitude areas but the location of the fitting session may be located in a relatively low-altitude area. Accordingly, the processing device 130 (e.g., via the input device 110) may receive the environment characteristic information 235 such as an approximate altitude of those golf courses so the trajectory analyzer 240 and/or the shot dispersion analyzer 250 may generate visual representations on the plurality of displays 300 based on the approximate altitude during the fitting session. As a result, the processing device 130 may use the shot characteristic information 230 (e.g., via the tracking device 120) and the environment characteristic information 235 to generate the trajectories 400 on the three-dimensional trajectory display 310, the trajectories 500 on the two-dimensional trajectory display 320, and/or the perimeters 600 on the shot dispersion display 330.

In another example, the individual 140 may typically use a particular brand of premium quality golf balls during a round of golf. Although the individual 140 may be hitting non-premium quality golf balls (e.g., driving range golf balls) during the fitting session, the processing device 130 (e.g., via the trajectory analyzer 240 and/or the shot dispersion analyzer 250) may provide virtual representations as if the individual 140 was using the particular brand of premium quality golf balls during the fitting session. For example, the individual 140 may be hitting non-premium quality golf balls during the fitting session but the trajectory analyzer 240 may use data associated with the particular brand of premium quality golf balls in conjunction with the shot characteristic information 230 to generate the trajectories 400 on the three-dimensional trajectory display 310 and/or the trajectories 500 on the two-dimensional trajectory display 320. The methods, apparatus, systems, and articles of manufacture described herein are not limited in this regard.

Although the above examples may describe the fitting system 100 to custom fit the individual 140 with golf clubs, the methods, apparatus, systems, and articles of manufacture described herein may be used in other suitable manners. In addition or in place of the component option display 340, for example, the processing device 130 may provide a multi-media display for informative or educational purposes. For example, the multi-media display may provide a video described various aspect of a golf club, the game of golf, etc. Thus, the processing device 130 may provide an informational or educational analysis instead of providing recommendations for one or more golf clubs.

Figure 7:
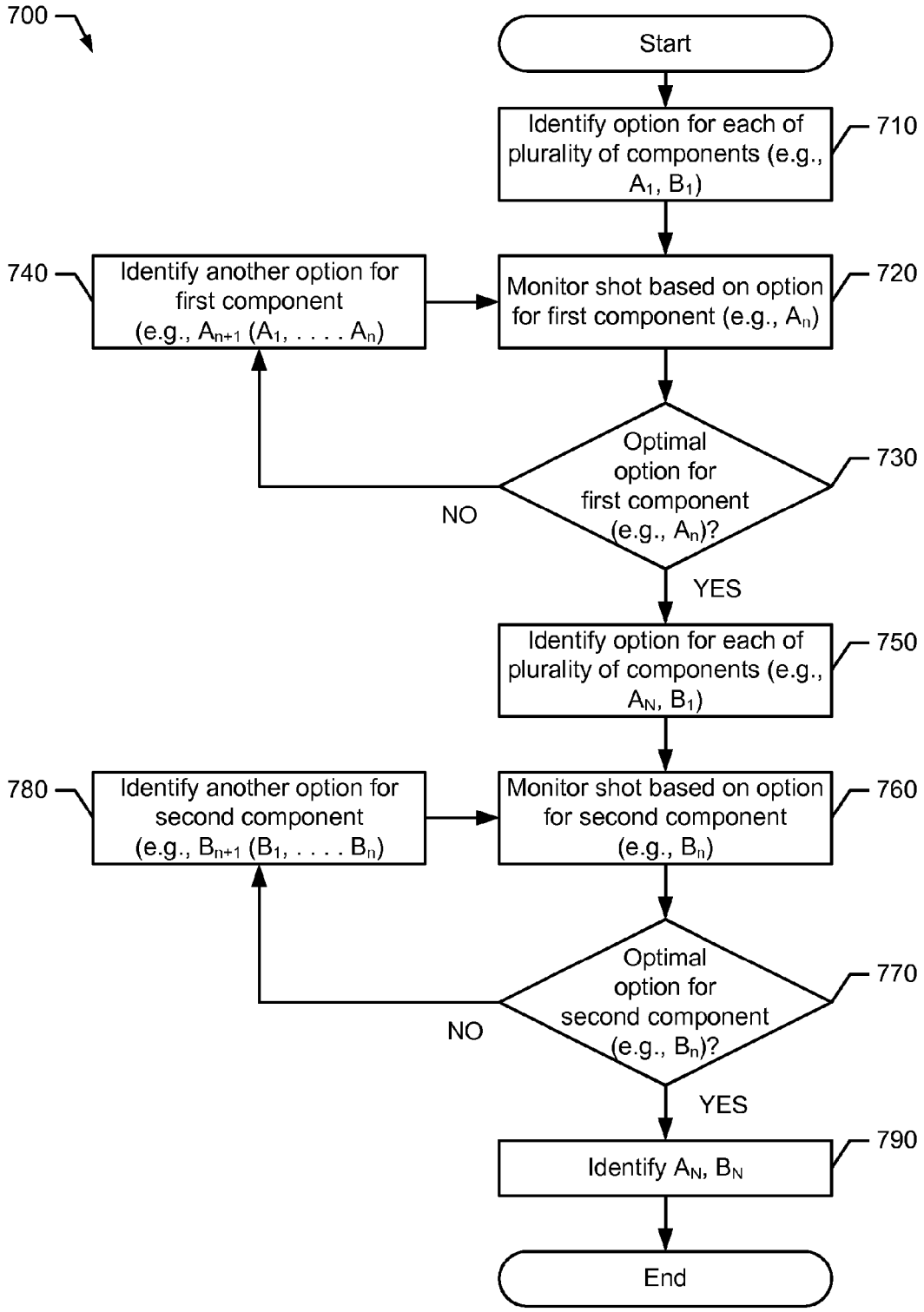
FIG. 7 depicts a flow diagram representation of one manner in which the example processing device of FIG. 2 may operate.

FIG. 7 depicts one manner in which the processing device 130 of FIG. 1 may be configured to identify components of a golf club to the individual 140 based on the physical characteristic information 210, the performance characteristic information 220, and/or the shot characteristic information 230 associated with the individual 140. The example process 700 may be implemented as machine-accessible instructions utilizing any of many different programming codes stored on any combination of machine-accessible media such as a volatile or nonvolatile memory or other mass storage device (e.g., a floppy disk, a CD, and a DVD). For example, the machine-accessible instructions may be embodied in a machine-accessible medium such as a programmable gate array, an application specific integrated circuit (ASIC), an erasable programmable read only memory (EPROM), a read only memory (ROM), a random access memory (RAM), a magnetic media, an optical media, and/or any other suitable type of medium.

Further, although a particular order of actions is illustrated in FIG. 7, these actions can be performed in other temporal sequences. Again, the example process 700 is merely provided and described in conjunction with the processing device 130 of FIGS. 1 and 2 as an example of one way to recommend a golf club to the individual 140. The example process 700 may also be used with an interchangeable component system (e.g., interchangeable club head/shaft system) to provide different combinations of options for various components of a golf club (e.g., model, loft, lie, shaft, length, grip, bounce, and/or weight).

In the example of FIG. 7, the process 700 (e.g., via the processing device 130 of FIGS. 1 and 2) may begin with identifying an option for each of a plurality of components of a golf club (block 710). In general, the process 700 may isolate each of the plurality components to determine the optimal option for each of the plurality of components. That is, the individual 140 may take one or more shots at a golf ball with a golf club including the first option of the first component. In one example, the fitting system 100 (FIG. 1) may be fitting the individual 140 for a driver-type golf club. Accordingly, the component option analyzer 230 may identify a particular model for the individual 140 based on the physical characteristic information 210 and the performance characteristic information 220). The process 700 may monitor (e.g., via the tracking device 120 of FIG. 1) one or more shots based on a first option of the first component (e.g., $A_1$) (block 720).

Based on the shot result from block 720, the component option analyzer 230 may determine whether the first option (e.g., $A_1$) is an optimal option for the first component (block 730). If the first option is not the optimal option for the first component, the process 700 may proceed to identify a second option of the first component (e.g., $A_2$) (block 740). The process 700 may continue as described above until the component option analyzer 260 identifies an optimal option for the first component (e.g., $A_N$).

Turning back to block 730, if the first option is the optimal option for the first component, the process 700 may proceed to identify an option for the second component based on the optimal option for the first component (block 750). Following the above example, the process 700 may determine an optimal loft associated with the optimal model. The process 700 may monitor (e.g., via the launch monitor 120 of FIG. 1) one or more shots based on a first option of the second component (e.g., $B_1$) (block 760).

Based on the shot result from block 760, the component option analyzer 230 may determine whether the first option (e.g., $B_1$) is an optimal option for the second component (block 770). If the first option is not the optimal option for the second component, the process 700 may proceed to identify a second option of the second component (e.g., $B_2$) (block 780). The process 700 may continue as described above until the component option analyzer 260 identifies an optimal option for the second component (e.g., $B_N$).

Turning back to block 770, if the first option is the optimal option for the second component, the process 700 may proceed to identify the optimal options for first and second components (e.g., $A_N$, $B_N$) (block 790).

Although FIG. 7 may depict identifying optimal options for two components, the methods, apparatus, systems, and articles of manufacture described herein may identify optimal options for more than two components. While a particular order of actions is illustrated in FIG. 7, these actions may be performed in other temporal sequences. For example, two or more actions depicted in FIG. 7 may be performed sequentially, concurrently, or simultaneously. The methods, apparatus, systems, and articles of manufacture described herein are not limited in this regard.

Figure 8:
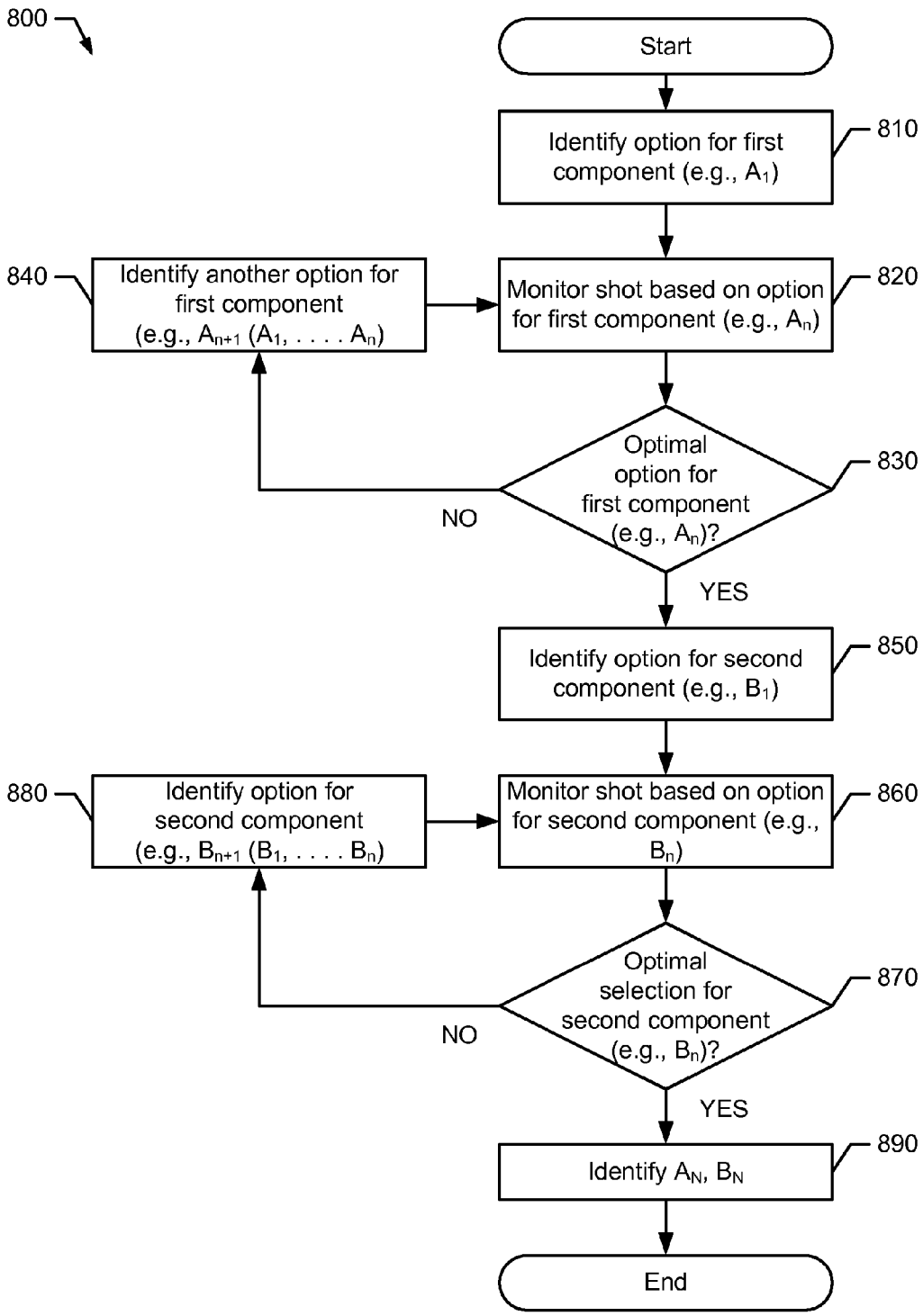
FIG. 8 depicts a flow diagram representation of another manner in which the example processing device of FIG. 2 may operate.

As noted above, the process 700 may initially identify an optimal option of an initial component. In response to identifying the optimal option of the initial component, the process 700 may identify an optimal option of a subsequent component based on the optimal option of the initial component. Alternatively as illustrated in FIG. 8, a process 800 may identify an optimal option of a component independent of an optimal option of another component. The process 800 may begin with identifying an option for each of a plurality of components of a golf club (block 810). The process 800 may monitor (e.g., via the launch monitor 120 of FIG. 1) one or more shots based on a first option of the first component (e.g., $A_1$) (block 820).

Based on the shot result from block 820, the component option analyzer 230 may determine whether the first option (e.g., $A_1$) is an optimal option for the first component (block 830). If the first option is not the optimal option for the first component, the process 800 may proceed to identify a second option of the first component (e.g., $A_2$) (block 840). The process 800 may continue as described above until the component option analyzer 260 identifies an optimal option for the first component (e.g., $A_N$).

Turning back to block 830, if the first option is the optimal option for the first component, the process 800 may proceed to identify an option for the second component independent of the optimal option for the first component (block 850). The process 800 may monitor (e.g., via the launch monitor 120 of FIG. 1) one or more shots based on a first option of the second component (e.g., $B_1$) (block 860).

Based on the shot result from block 860, the component option analyzer 230 may determine whether the first option (e.g., $B_1$) is an optimal option for the second component (block 870). If the first option is not the optimal option for the second component, the process 800 may proceed to identify a second option of the second component (e.g., $B_2$) (block 880). The process 800 may continue as described above until the component option analyzer 260 identifies an optimal option for the second component (e.g., $B_N$).

Turning back to block 870, if the first option is the optimal option for the second component, the process 800 may proceed to identify the optimal options for the first and second components (e.g., $A_N$, $B_N$) (block 890).

Although FIG. 8 may depict identifying optimal options for two components, the methods, apparatus, systems, and articles of manufacture described herein may identify optimal options for more than two components. While a particular order of actions is illustrated in FIG. 8, these actions may be performed in other temporal sequences. For example, two or more actions depicted in FIG. 8 may be performed sequentially, concurrently, or simultaneously. The methods, apparatus, systems, and articles of manufacture described herein are not limited in this regard.

Figure 9:
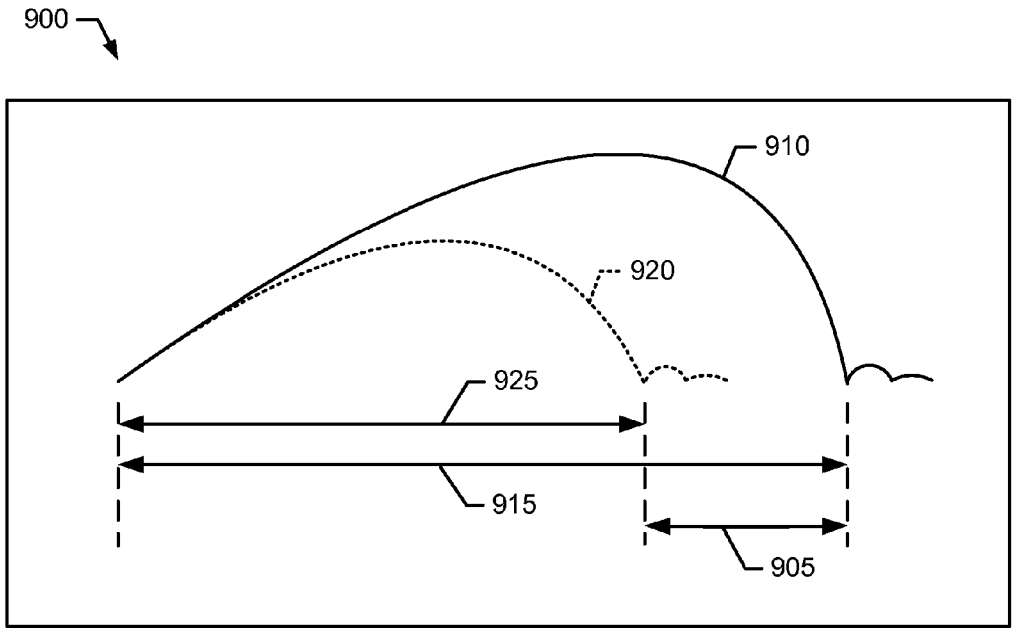
FIG. 9 depicts a visual diagram representation of another example display of the example fitting system of FIG. 1.
Figure 10:
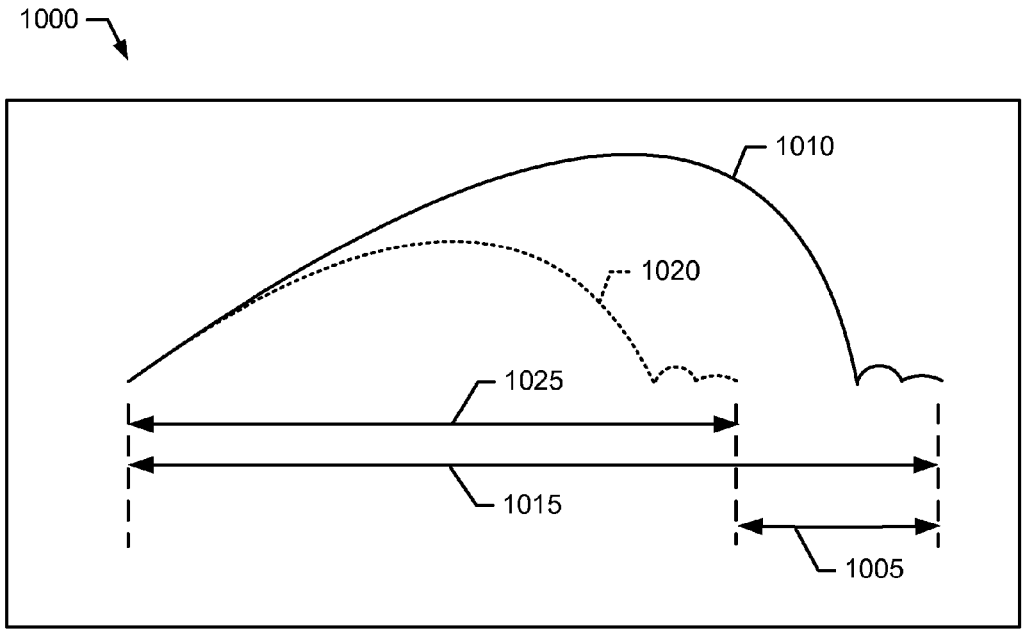
FIG. 10 depicts a visual diagram representation of another example display of the example fitting system of FIG. 1.

In the example of FIGS. 9 and 10, the processing device 130 may generate one or more gapping analysis displays, generally shown as 900 and 1000, respectively. Each of the gapping analysis displays 900 and 1000 may provide visual representation of at least one gap distance, generally shown as 905 and 1005, respectively, between two shots using different golf clubs (e.g., two golf clubs within a set). The gap distance 905 may be a distance between carry distances between two shots taken with two different golf clubs. In one example, the individual 140 may strike a golf ball with a 6-iron golf club for 150 yards whereas the individual 140 may strike a golf ball with a 5-iron golf club for 160 yards. Accordingly, the gap distance 905 between the 5-iron and 6-iron golf clubs may be ten yards. Further, carry distance, generally shown as 910 and 920 of FIG. 9, may be a distance traveled by a golf ball from impact with a golf club to landing. As a result, the gap distance 905 may be a distance between the carry distance 910 associated with a first shot 915 and the carry distance 920 associated with a second shot 925. The methods, apparatus, systems, and articles of manufacture described herein are not limited in this regard.

Alternatively as illustrated in FIG. 10, the gap distance 1005 may be a distance between total distances between two shots taken with two different golf clubs. In particular, the gap distance 1005 may be a distance between total distances between two shots taken with two different golf clubs. Total distance, generally shown as 1010 and 1020, may be the carry distance 920 and 930, respectively, plus a distance traveled by the golf ball after landing to a final resting position. As a result, the gap distance 1005 may be a distance between the total distance 1010 associated with a first shot 915 and the total distance 1020 associated with a second shot 925. The methods, apparatus, systems, and articles of manufacture described herein are not limited in this regard.

Golf ruling bodies may define the number of golf clubs available to the individual 140 during a round of golf (e.g., the number of golf clubs that the individual 140 may carry in a golf bag). For example, the individual 140 may be permitted to carry up to fourteen clubs in his/her bag. However, the individual 140 may not be able to use all fourteen clubs effectively. As described in detail below, maintaining consistent gaps between the spectrum of golf clubs in a set (e.g., fairway wood-type golf clubs, hybrid-type golf clubs, iron-type golf clubs, wedge-type golf clubs, etc.) may assist the performance of the individual 140. Alternatively, the individual 140 may have, use, and/or purchase more than fourteen golf clubs to have alternative options based on course conditions.

In general, the gapping analyzer 270 (FIG. 2) may analyze the physical characteristic information 210, the performance characteristic information 220, and/or the shot characteristic information 230 to provide a set of golf clubs with consistent gaps. In addition to swing speed of the individual 140, the gapping analyzer 270 may use the shot characteristic information 230 such as ball speed, ball launch angle, and ball spin rate of two or more shots associated with two or more golf clubs to calculate and extrapolate ball launch parameters (e.g., ball speed, ball launch angle, ball spin rate, etc.) for other golf clubs that the individual 140 may use. In one example, the individual 140 may take two or more shots with a first golf club (e.g., 7-iron). The individual 140 may also take two or more shots with a second golf club (e.g., hybrid 22°). Based on the shot characteristic information 230 of these shots and reference data of golf clubs that were not use by the individual 140 to take any shots during the fitting process, the gapping analyzer 270 may estimate ball launch parameters of various golf clubs for the individual 140. For example, the reference data may be calculated and/or measured from shots taken by other individuals. The reference data may be stored in a database 290 (FIG. 2). The methods, apparatus, systems, and articles of manufacture described herein are not limited in this regard.

Referring to FIG. 11, for example, the gapping analyzer 270 may identify a plurality of golf clubs to complete a set associated with a substantially uniform gap distance. In one example, a gap distance may be the difference between two carry distances of two neighboring clubs. In particular, the gapping analyzer 270 may identify twelve golf clubs of a set with a substantially uniform gap distance between two neighboring golf clubs of the set (e.g., excluding a driver-type golf club and a putter-type golf club). Following the above example, the gap distance 1110 between the 8-iron golf club and the 7-iron golf club for the individual 140 may be ten yards (e.g., the carry distances are 130 and 140 yards, respectively). Accordingly, the substantially uniform gap distance between two neighboring golf clubs of the set may also be about ten yards as well. In one example, the gap distance 1120 between the 7-iron golf club and the 6-iron golf club may be ten yards (e.g., the carry distances are 140 and 150 yards, respectively). In a similar manner, the gap distance 1130 between the 6-iron golf club and the 5-iron golf club may also be ten yards (e.g., the carry distances are 150 and 160 yards, respectively).

In contrast to the gap distances 1110, 1120, and 1130, the gap distance 1140 between the 5-iron golf club and the 4-iron golf club for the individual 140 may be less than the substantially uniform gap distance of ten yards. Accordingly, the gapping analyzer 270 may identify a hybrid-type golf club instead of a 4-iron golf club to the individual 140 because the gap distance 1140 between the 5-iron golf club and the 4-iron golf club is less than the uniform gap distance of ten yards. To maintain a ten-yard gap distance between the 5-iron type golf club and the next golf club within the set, the gapping analyzer 270 may identify the hybrid 22° golf club because the gap distance between the 5-iron golf club and the hybrid 22° golf club may be ten yards (e.g., the carry distances for the 5-iron golf club and the hybrid 22° golf club are 160 and 170 yards, respectively). In another example, the gapping analyzer 270 may identify the hybrid 18° golf club instead of the hybrid 15° golf club because the gap distance between the hybrid 22° golf club and the hybrid 18° golf club may be ten yards (e.g., the carry distances are 170 and 180 yards, respectively) whereas the gap distance between the hybrid 22° golf club and the hybrid 15° golf club may be fifteen yards (e.g., the carry distances are 170 and 185 yards, respectively). By using the shot characteristic information 230 (e.g., ball speed, ball launch angle, ball spin rate, etc.) in addition to swing speed of the individual 140, the gapping analyzer 270 may provide substantially uniform gap distances between two neighboring golf clubs within a set.

Alternatively, the gapping analyzer 270 may identify a progression in gap distances in a set of golf clubs (e.g., the gap distance between two neighboring golf clubs in the set may get wider or narrower through the set). In particular, the gapping analyzer 270 may identify a first gap distance for a first group of golf clubs in the set and a second gap distance for second group of golf clubs in the same set. In one example, the gapping analyzer 270 may identify the first gap distance of eight yards for the wedge-type golf clubs in a set, and a second gap distance of ten yards for the iron-type golf clubs. Further, the gapping analyzer 270 may identify a third gap distance of 15 yards for the fairway wood-type golf clubs.

Although the above example may describe the gap distance as the difference between two carry distances of two neighboring clubs, the gap distance may be the difference between two total distances of two neighboring clubs. The methods, apparatus, systems, and articles of manufacture described herein are not limited in this regard.

Figure 12:
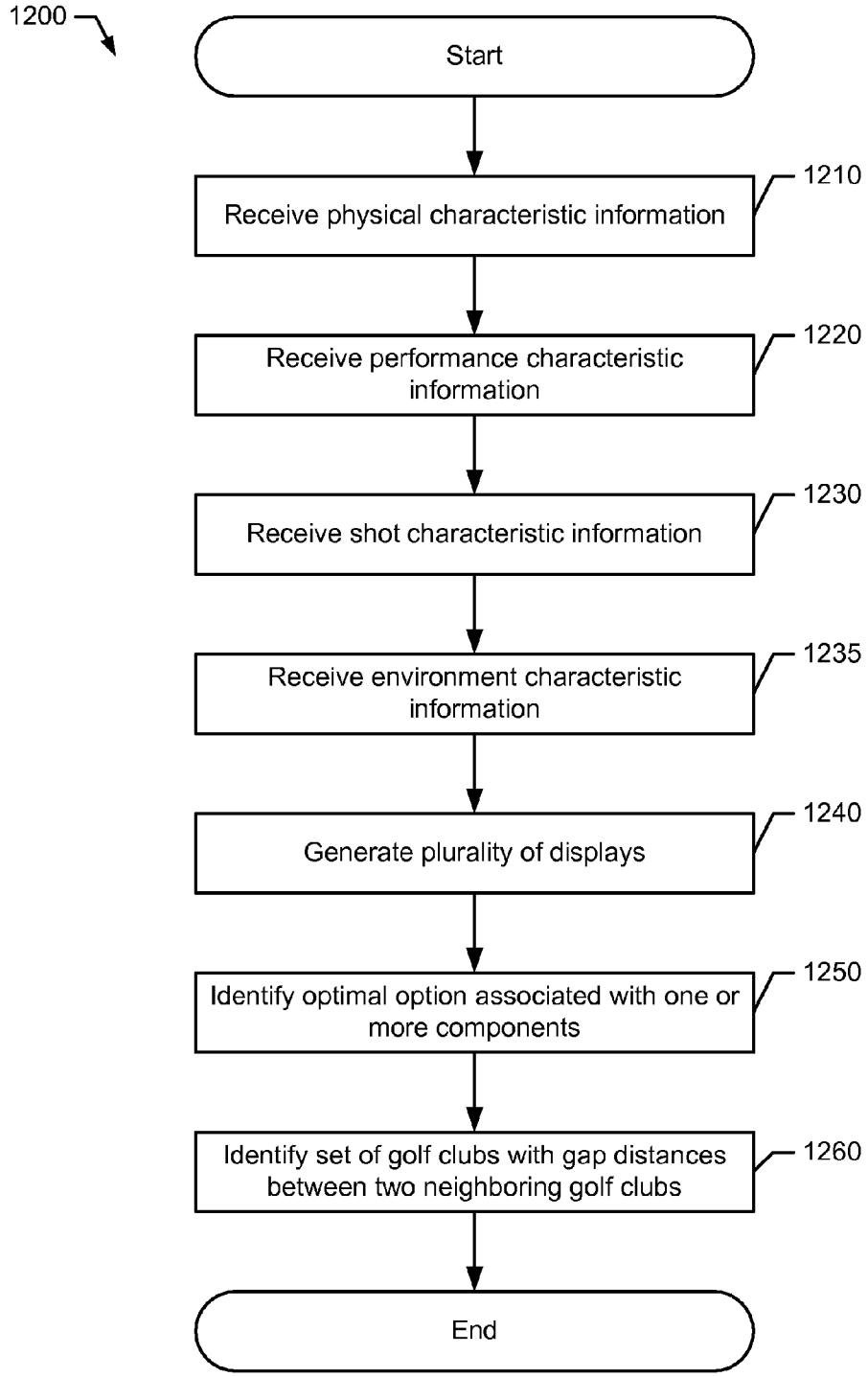
FIG. 12 depicts a flow diagram representation of one manner in which the example fitting system of FIG. 1 may operate.

In the example of FIG. 12, a process 1200 (e.g., via the processing device 130 of FIG. 1) may begin with receiving the physical characteristic information 210 associated with the individual 140 (e.g., via the input device 110) (block 1210). The process 1200 may also receive the performance characteristic information 220 associated with the individual 140 (e.g., via the input device 110) (block 1220). In addition, the process 1200 may receive the shot characteristic information 230 associated with the individual 140 (e.g., via the tracking device 120) (block 1230). Further, the process 1200 may receive the environment characteristic information 235 associated with the individual 140 (e.g., via the tracking device 120) (block 1235).

Based on the physical characteristic information 210, the performance characteristic information 220, the shot characteristic information 230, and/or the environment characteristic information 235, the process 1200 (e.g., via the trajectory analyzer 240, the shot dispersion analyzer 250, the component option analyzer 260, and/or the graphical user interface 280) may generate the plurality of displays 300 (block 1240). In addition, the process 1200 (e.g., via the component option analyzer 260) may identify an optimal option associated with one or more components of a golf club (block 1250). Further, the process 1200 (e.g., via the gapping analyzer 270) may identify a set of golf clubs with gap distances between two neighboring golf clubs in the set (block 1260). As noted above, the gap distances may be substantially uniform throughout the set of golf clubs. Alternatively, the gap distances may increase or decrease progressively based on the type of golf clubs throughout the set of golf clubs.

While a particular order of actions is illustrated in FIG. 12, these actions may be performed in other temporal sequences. For example, two or more actions depicted in FIG. 12 may be performed sequentially, concurrently, or simultaneously. Further, one or more actions depicted in FIG. 12 may not be performed at all. In one example, the process 1200 may not perform the block 1260 (e.g., the process 1200 may end after block 1250). The methods, apparatus, systems, and articles of manufacture described herein are not limited in this regard.

In addition to monitoring and recording movement of a golf ball as described above, the fitting system 100 (e.g., via the tracking device 120) may also monitor and record movement of a golf club head of a golf club (e.g., a golf club identified as described above or another golf club). The fitting system 100 may translate the movement of the golf ball and/or the golf club head onto a digital model as a three-dimensional video depiction of a golf swing (e.g., a swing at a golf ball with a golf club by the individual). In particular, the graphical user interface 280 (FIG. 2) may generate a display to depict a golf swing such as prior to impact of golf ball by a club head of a golf club (e.g., FIG. 13), during impact of the golf ball by the club head (e.g., FIG. 14), and after impact of the golf ball by the club head (e.g., FIG. 15). That is, FIGS. 13, 14, and 15 may be portions of a three-dimensional motion capture of a golf swing.

Figure 13:
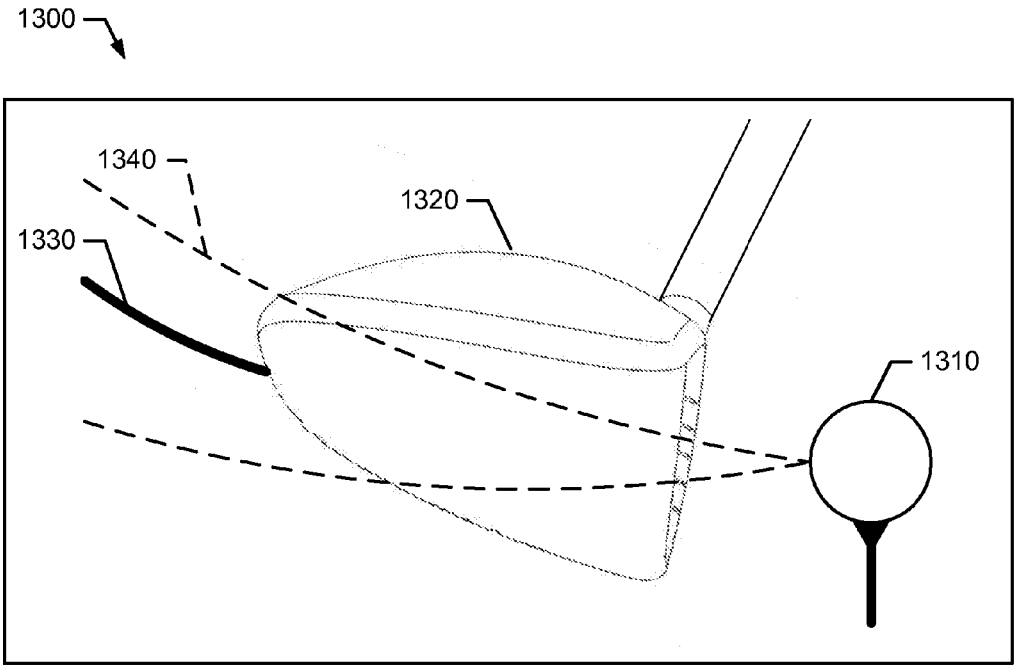
FIG. 13 depicts a visual diagram representation of another example display of the example fitting system of FIG. 1.
Figure 16:
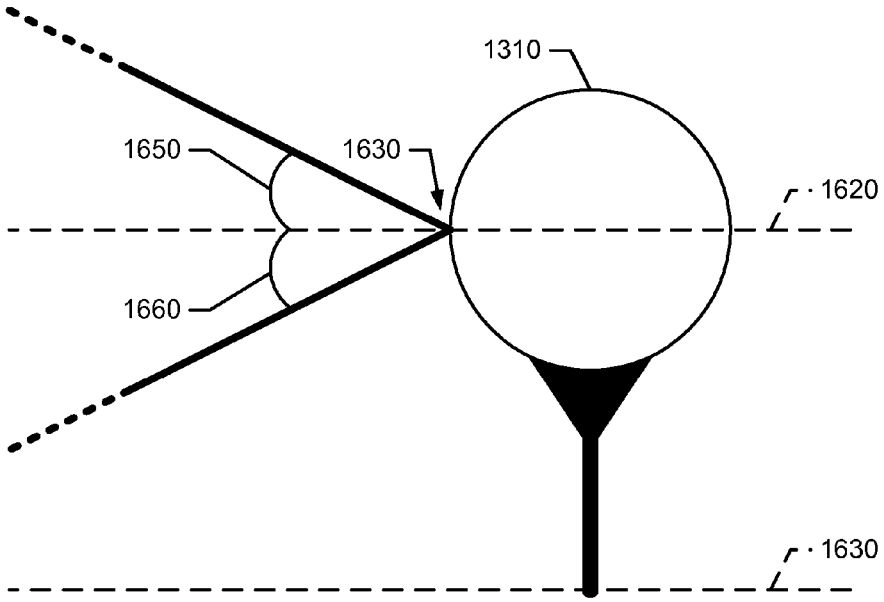
FIG. 16 depicts a visual diagram representation of attack angles associated with the example fitting system of FIG. 1.

In the example of FIG. 13, a three-dimensional swing display 1300 may depict a golf swing prior to impact of a golf ball 1310 by a club head 1320 of a golf club. The club head 1320 may approach the golf ball 1310 at a particular attack angle. Referring to FIG. 16, for example, an attack angle may be defined as an angle of approach by a club head to impact a golf ball 1310. In particular, the attack angle may be defined relative to a horizontal plane 1620. The horizontal plane 1620 may be substantially parallel to a ground plane 1630 and may intersect an optimal impact area 1640 on a golf ball 1610. The attack angle may be a negative attack angle 1650 or a positive attack angle 1660. For example, a negative attack angle 1650 may be defined as an angle of approach by a club head to impact the golf ball 1610 during a downswing portion of a golf swing (e.g., −10 degrees or a descending angle of 10 degrees). A positive attack angle 1660 may be defined as an angle of approach by a club head to impact the golf ball 1640 during an upswing portion of a golf swing (e.g., +5 degrees or an ascending angle of 5 degrees).

Turning back to FIG. 13, the three-dimensional swing display 1300 may include an attack angle path 1330 indicative of the attack angle of the club head 1320 associated with a golf swing. The three-dimensional 1300 may also include an attack-angle reference band 1340. The attack-angle reference band 1340 may be indicative of a range of reference attack angles (e.g., a range between +10 degrees to −20 degrees or other suitable ranges). In one example, the attack-angle reference band 1340 may be +5 degrees to −5 degrees. Further, the attack-angle reference band 1340 may be based on information associated with attack angles monitored from shots by a number of individuals, which may be stored on the database 290 (FIG. 2). In addition or alternatively, the attack-angle reference band 1340 may be based on information associated with attack angles calculated from optimal shots. If the attack angle path 1330 is within the attack-angle reference band 1340 then the golf swing may produce more desirable results whereas if the attack angle path 1330 is outside the attack-angle reference band 1340 then the golf swing may produce less desirable results. The methods, apparatus, systems, and articles of manufacture described herein are not limited in this regard.

Figure 14:
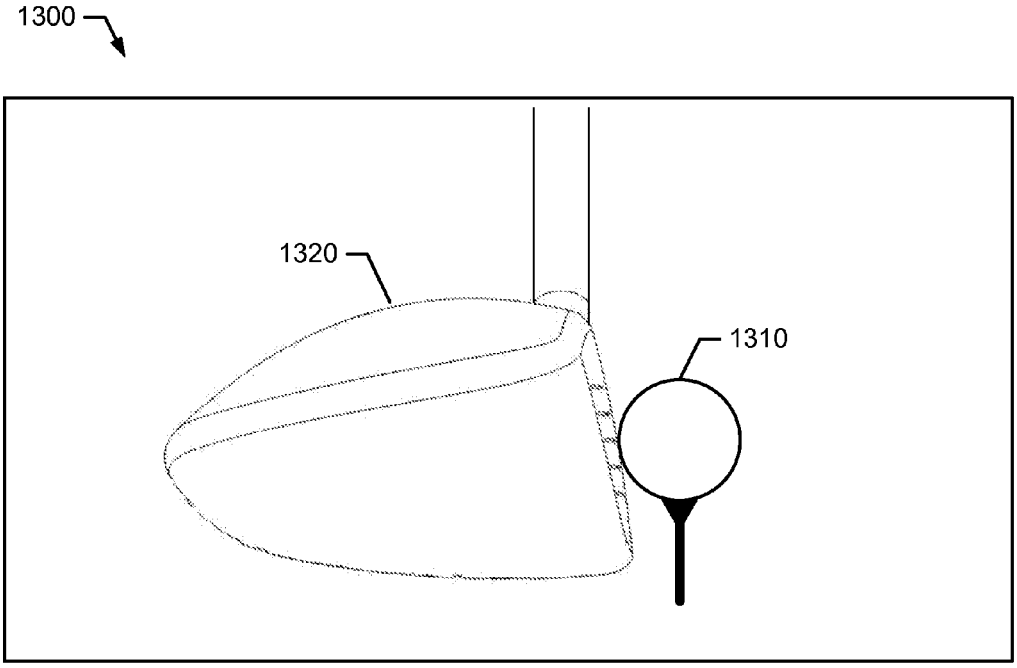
FIG. 14 depicts a visual diagram representation of another example display of the example fitting system of FIG. 1.
Figure 15:
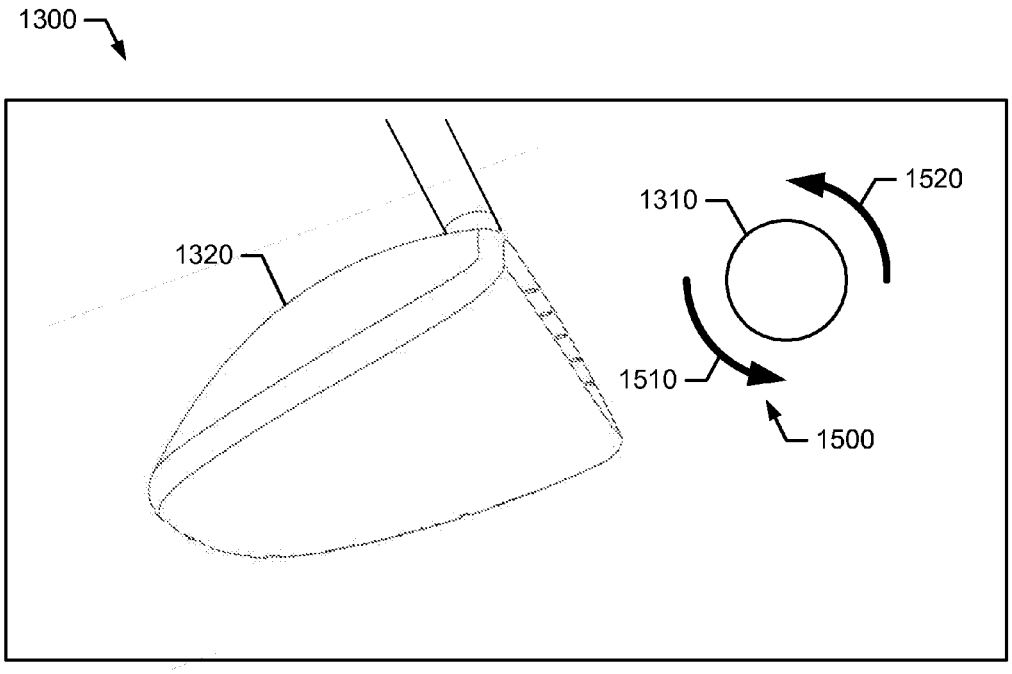
FIG. 15 depicts a visual diagram representation of another example display of the example fitting system of FIG. 1.

In the example of FIG. 14, the three-dimensional swing display 1300 may depict a golf swing at (or immediately before) impact of the golf ball 1310 by the club head 1320. Referring to FIG. 15, for example, the three-dimensional swing display 1300 may depict a golf swing after impact of the golf ball 1310 by the club head 1320. In particular, the three-dimensional swing display 1300 may include one or more arrows 1500, generally shown as 1510 and 1520, indicative of a direction of rotation associated with the golf ball 1310 (e.g., spin of the golf ball 1310). Further, the graphical user interface 280 may transition from the three-dimensional swing display 1300 to the three-dimensional trajectory display 310 so that the trajectory of the golf swing may be provided (e.g., zoom out).

Although FIGS. 13, 14, and 15 may be a sample, a frame, a still image, or a screen shot of a golf swing at various time, the three-dimensional swing display 1300 may provide a video depiction of the golf swing at various speed including real-time speed (e.g., the golf swing in motion). Audio depiction of the golf swing may be included as well. Further, while FIGS. 13, 14, and 15 may depict a particular viewing angle (e.g., a side view), the three-dimensional swing display 1300 may be rotated to provide other views of the golf swing (e.g., a top view, a back view, etc.).

Figure 17:
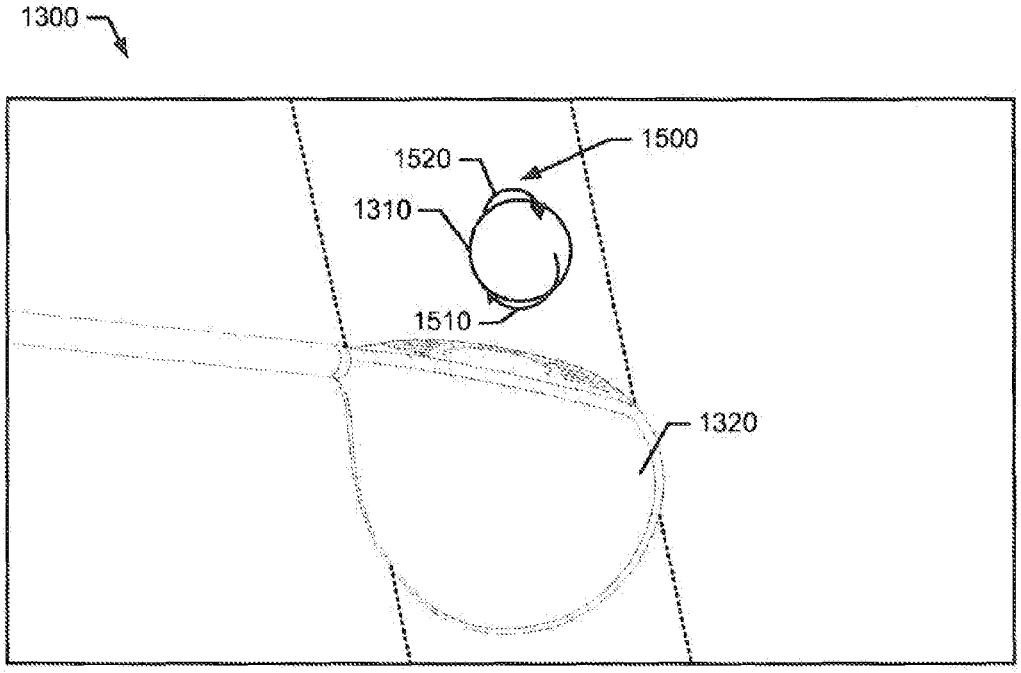
FIG. 17 depicts a visual diagram representation of another example display of the example fitting system of FIG. 1.

Referring to FIG. 17, for example, the three-dimensional swing display 1300 may be a top view depicting a golf swing associated with the individual 160 after impact of the golf ball 1310 by the club head 1320. In particular, the three-dimensional swing display 1300 may include arrow(s) 1500 (e.g., 1510 and 1520) indicative of a direction of rotation associated with the golf ball 1310. In particular, the arrow(s) 1500 may include a tilt to indicate a direction of rotation of the golf ball 1310. In one example, right-tilted arrow(s) 1500 as shown in FIG. 17 may be indicative of a right-bended shot (e.g., a push shot, a fade shot, a slice shot, etc.). In another example, left-tilted arrow(s) 1500 may be indicative of a left-bended shot (e.g., a pull shot, a draw shot, a hook shot, etc.). The methods, apparatus, systems, and articles of manufacture described herein are not limited in this regard.

Figure 18:
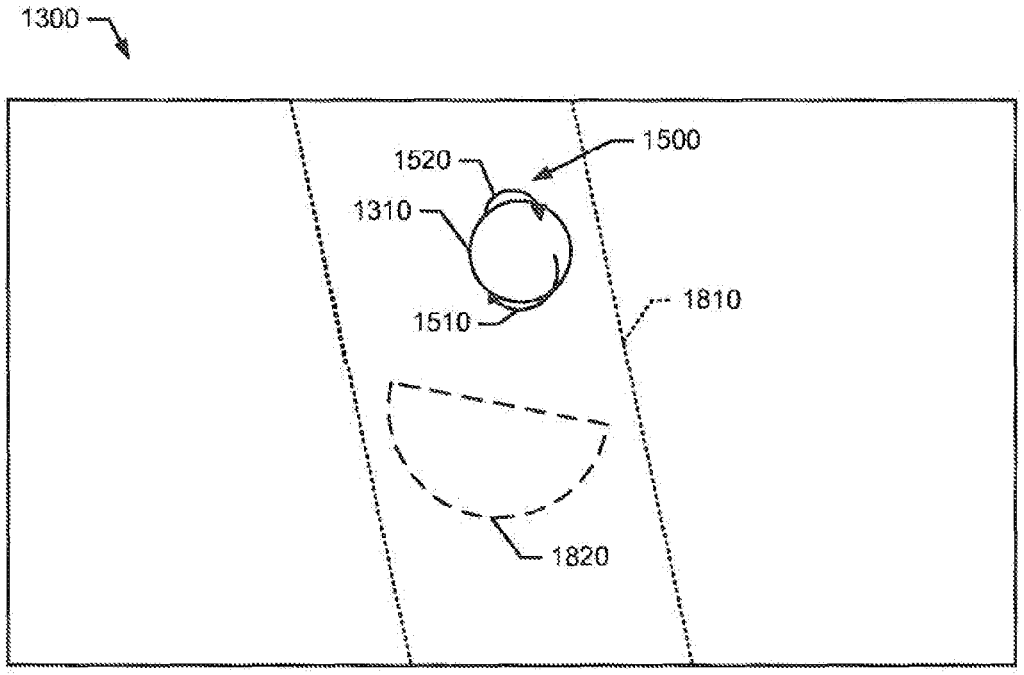
FIG. 18 depicts a visual diagram representation of another example display of the example fitting system of FIG. 1.

Turning to FIG. 18, for example, the three-dimensional swing display 1300 may include a swing path 1810 of a golf swing associated with the individual 160. In particular, the swing path 1810 may indicative of a direction of a golf swing. The three-dimensional swing display 1300 may include a range of swing paths (e.g., a range of +20 degrees to −20 degrees relative to a target or other suitable ranges). For a right-handed individual, for example, a golf swing may be an outside-to-inside golf swing represented by the swing path 1810 (e.g., −10 degrees relative to a target). Alternatively, a golf swing may be an inside-to-outside golf swing (e.g., +10 degrees relative to a target).

Further, the three-dimensional display 1300 may include a club face indicator 1820. The club face indicator 1820 may be indicative of a position of the club face associated with the club head 1320 relative to the swing path 1810. The club face indicator 1820 may provide a visual depiction of the club head 1320 to determine whether a club face of the club head 1320 is squared or substantially perpendicular relative to the swing path 1810 for an optimal shot. The three-dimensional swing display 1300 may include a range of club face indicators (e.g., a range of +20 degrees to −20 degrees relative to the swing path 1810 or other suitable ranges). In one example, an outside-to-inside golf swing with an open club face may result in a slice shot whereas an outside-to-inside golf swing with a closed club face may result in a hook shot. An outside-to-inside golf swing with a squared club face may result in an inline shot (e.g., relatively straight shot).

Although FIG. 18 may depict particular shapes and sizes associated with the swing path 1810 and the club face indicator 1820, the swing path 1810 and the club face indicator 1820 may be associated with other suitable shape, size, and/or color. For example, while FIG. 18 may depict the club face indicator 1820 as a semi-circle, the club face indicator 1820 may be a triangle or a square with one of the sides representing the club face of a club head. Further, while the club head 1320 and the club face indicator 1820 may be depicted in separate figures (e.g., FIGS. 17 and 18) for description of these features, the three-dimensional swing display 1300 may depict the club head 1320 (and the shaft) and the club face indicator 1820 may be together in a single view (e.g., a back view). The methods, apparatus, systems, and articles of manufacture described herein are not limited in this regard.

Figure 19:
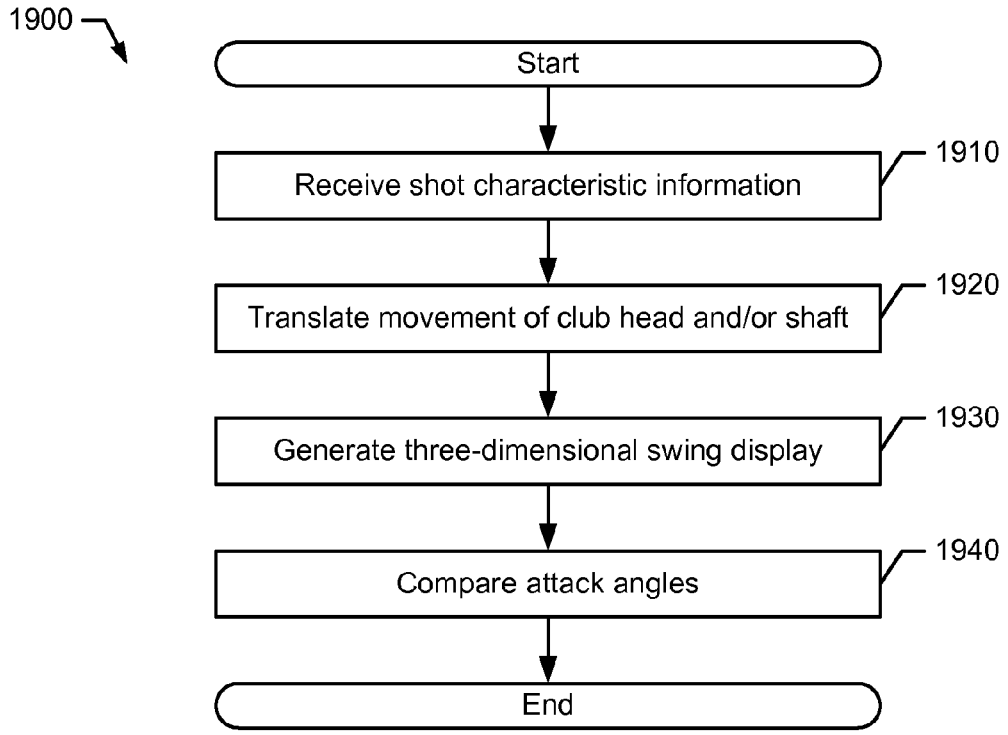
FIG. 19 depicts a flow diagram representation of another manner in which the example fitting system of FIG. 1 may operate.

In the example of FIG. 19, a process 1900 (e.g., via the processing device 130 of FIG. 1) may begin with receiving the shot characteristic information 230 (FIG. 2) associated with the individual 160 (FIG. 1) (block 1910). The shot characteristic information 230 may include information associated with an attack angle associated with a swing at a golf ball with a golf club by the individual 160. The shot characteristic information 230 may also include information associated with movement of at least one of a club head or a shaft associated with the golf club. In particular, the tracking device 120 (FIG. 1) may monitor movement of the club head and/or the shaft associated with the golf club before, during, and/or after the impact between the club head and the golf ball. The process 1900 (e.g., via the swing analyzer 275 of FIG. 1) may translate the movement of the club head and/or the shaft associated with the golf club (block 1920).

Accordingly, the process 1900 may generate a three-dimensional swing display 1300 (FIG. 13) (e.g., via the swing analyzer 275 of FIG. 1) associated with a swing at a ball with a golf club by the individual based on the shot characteristic information 230 (block 1920). In particular, the three-dimensional swing display 1300 may include a path indicative of an attack angle associated with the swing 1330 (FIG. 13), and a band indicative of a range of reference attack angles 1340 (FIG. 13).

Further, the process 1900 may compare two or more attack angles of a plurality of swings (block 1940). In particular, the process 1900 may compare attack angles of two swings associated with the individual 160 at a substantially identical swing stage. In one example, the process 1900 may compare the attack angles of two swings before impact between the club head and the golf ball (e.g., FIG. 13). In another example, the process 1900 may compare the attack angles of two swings immediately before or during impact between the club head and the golf ball (e.g., FIG. 14). In yet another example, the process 1900 may compare the attack angles of two swings after impact between the club head and the golf ball (e.g., FIG. 15).

Although the process 1900 may be depicted as a separate process in FIG. 19, the process 1900 may be performed sequentially, concurrently, or simultaneously with other processes associated with the methods, apparatus, systems, and articles of manufactured described herein (e.g., the process 1200 of FIG. 12). While a particular order of actions is illustrated in FIG. 19, these actions may be performed in other temporal sequences. For example, two or more actions depicted in FIG. 19 may be performed sequentially, concurrently, or simultaneously. Further, one or more actions depicted in FIG. 19 may not be performed at all. In one example, the process 1900 may not perform the block 1940 (e.g., the process 1900 may end after block 1920). The methods, apparatus, systems, and articles of manufacture described herein are not limited in this regard.

As noted above, the fitting system 100 (FIG. 1) may analyze various information (e.g., the performance characteristic information 220 associated with the individual 140) to identify an optimal option for one or more components of a golf club such as shafts. In particular, the processing device 130 (e.g., via the component option analyzer 260 of FIG. 2) may identify and recommend shafts based on shaft characteristic information associated with a plurality of shafts, which may be stored in a local database (e.g., the database 290 of FIG. 2) and/or an offsite database. For example, shaft characteristics may include mass, center of mass (or center of gravity), flex, tip flex, torque, stiffness, tip stiffness, torsional stiffness, stiffness ratio, average flexural rigidity, average torsional rigidity, trajectory effect or launch angle effect, feel effect or responsiveness effect, and/or other suitable characteristics associated with a shaft as described in detail below.

The mass of a shaft may be measured in grams (g). A relatively lighter shaft may result in a relatively higher ball flight and a softer feel whereas a relatively heavier shaft may result in a relatively lower ball flight and a stiffer feel.

The center of mass of a shaft may be measured from a butt portion of the shaft with the shaft being suspended parallel to a ground plane. A center-of-mass location relatively closer to the butt portion of the shaft may result in a relatively lighter feel whereas a center-of-mass location relatively closer to the tip portion of the shaft may result in a relatively heavier feel.

The flex of a shaft may indicate an amount of overall deflection or bend (e.g., measured in inches) in response to an amount of load applied to the shaft (e.g., tangential force). In general, a shaft may include a tip portion at or proximate to one end of the shaft, and a butt portion at or proximate to the opposite end of the tip portion. The tip portion may be coupled to a club head of a golf club whereas the butt portion may be coupled to a grip of the golf club. In one example to measure the flex of a shaft, four pounds (4 lbs.) of load may be applied to one inch (1") from the tip portion of the shaft (e.g., one end of the shaft) while the shaft may be clamped six inches (6") from the butt portion of the shaft (e.g., opposite end of the tip portion of the shaft). A relatively smaller flex value may indicate a relatively stiffer shaft whereas a relatively larger flex value may indicate a relatively softer shaft.

The tip flex of a shaft may indicate an amount of deflection or bend (e.g., measured in inches) of the tip portion of the shaft in response to in response to an amount of load applied to the butt portion of the shaft (e.g., tangential force). In one example to measure the tip flex stiffness of a shaft, four pounds (4 lbs.) of load applied to one inch (1") from the butt portion of the shaft while the shaft may be clamped six inches (6") from the tip portion of the shaft. A relatively smaller tip flex value may indicate a shaft with a relatively stiffer tip portion whereas a relatively larger tip flex value may indicate a shaft with a relatively softer tip portion.

The torque of a shaft may indicate an amount of twist (e.g., degrees) in response to a particular amount of foot-pound force (ft.*lb.) applied to the shaft (e.g., five ft.*lb.). A relatively smaller torque value may indicate a relatively more torsionally rigid shaft whereas a relatively larger torque value may indicate a relatively less torsionally rigid shaft. For example, a shaft with a relatively smaller torque value may provide a board feel whereas a shaft with a relatively larger torque value may provide a smooth feel.

The stiffness of a shaft may be based on a normalized length, the mass, and the flex of the shaft. The stiffness of the shaft may be inversely proportional to the flex of the shaft. In a similar manner, the tip stiffness of a shaft may be based on a normalized length, the mass, and the tip flex of the shaft. The tip stiffness of the shaft may be inversely proportional to the tip flex of the shaft. Further, the torsional stiffness of a shaft may be based on an overall length, the mass, and the torque of the shaft. The torsional stiffness of the shaft may be inversely proportional to the torque of the shaft.

The stiffness ratio may be a percentage of the tip stiffness value divided by the stiffness value of a shaft. In particular, the stiffness ratio may provide the stiffness of the tip portion of the shaft relative to the overall stiffness of the shaft. The stiffness ratio may be used to determine a flex profile or a bend profile of a shaft (e.g., kick-point or flex-point). A relatively smaller stiffness ratio may indicate a shaft with a relatively softer tip portion whereas relatively larger stiffness ratio may indicate a shaft with a relatively stiffer tip portion.

The average flexural rigidity (EI (avg.)) value may indicate the material modulus of elasticity (E) and the polar area moment of inertia (I) of a shaft (e.g., lbs.*in$^2$). In one example, a shaft with an EI (avg.) value of 20,000 may be about twice as stiff as a shaft with an EI (avg.) of 10,000.

The average torsional rigidity (GJ (avg.)) value may indicate the shear modulus of elasticity (G) and the polar moment of inertia (J) of a shaft (e.g., lbs.*in$^2$/1000). In one example, a shaft with a GJ (avg.) value of 12.0 may be about twice as torsionally rigid as a shaft with a GJ (avg.) value of 6.0.

The trajectory effect or launch angle effect value may be calculated based on various physical properties such as geometrical shape, mass, torque, and/or stiffness of a shaft. For example, a relatively higher trajectory effect value may result in a relatively higher trajectory ball flight by increasing an initial launch angle and/or spin rate. In contrast, a relatively lower trajectory effect value may result in a relatively lower ball flight by decreasing an initial launch angle and/or spin rate.

The feel effect or responsive effect value may also be calculated based on various physical properties such as geometrical shape, mass, torque, and/or stiffness of a shaft. For example, a relatively higher feel effect value may produce a relatively softer feel (e.g., "lively"). In contrast, a relatively lower feel effect value may produce a relatively more rigid feel (e.g., "boardy").

In general, a reference shaft may be selected based on the performance characteristic information 220 associated with the individual 140. During a fitting session, for example, the individual 140 may take one or more shots with a golf club having the reference shaft. Based on shaft feedback information from the individual 140 (e.g., different performance and/or feel), the processing device 130 (FIG. 1) may recommend one or more shafts. In particular, the component option analyzer 260 may compare the shaft characteristic information of the reference shaft and a plurality of available shafts based on the shaft feedback information from the individual 140 to identify one or more recommended shafts from the plurality of available shafts. The shaft feedback information may be entered via the input device 110 (FIG. 1). The component option analyzer 260 may retrieve the shaft characteristic information from a local database (e.g., the database 290 of FIG. 2) and/or an offsite database for the comparison. Further, the component option analyzer 260 may generate a shaft ranking of the one or more recommended shafts. As a result, the individual 140 may select a shaft from the one or more recommended shafts based on the shaft ranking.

Figure 20:
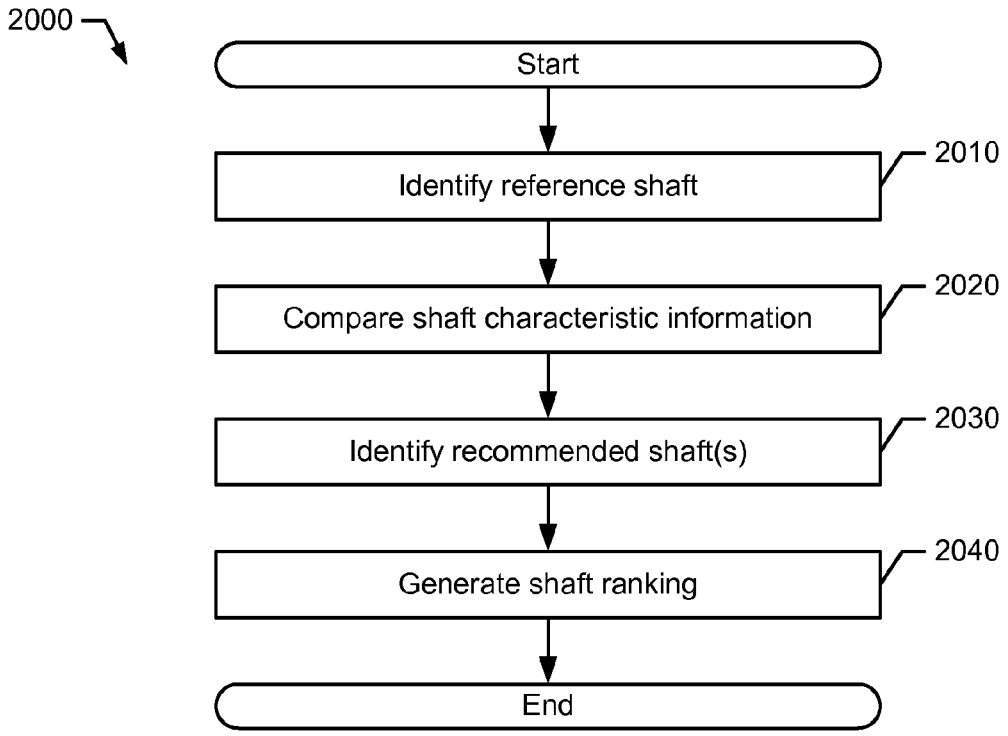
FIG. 20 depicts a flow diagram representation of another manner in which the example fitting system of FIG. 1 may operate.

In the example of FIG. 20, a process 2000 (e.g., via the processing device 130 of FIG. 1) may begin with identifying a reference shaft (block 2010). The process 2000 may identify the reference shaft based on the performance characteristic information 220 of the individual 140. In addition or alternatively, the process 2000 may identify the reference shaft based on other information such as the physical characteristic information 210 and/or the shot characteristic information 230 of the individual 140. In another example, the process 2000 may arbitrarily identify a reference shaft.

The process 2000 (e.g., via the component option analyzer 260 of FIG. 2) may compare the shaft characteristic information of the reference shaft and a plurality of available shafts based on shaft feedback information from the individual 140 (block 2020). The process 2000 may compare performance and/or feel of the reference shaft to the plurality of available shafts. In one example, the preference of the individual 140 may include shaft responsiveness (e.g., more lively or more stable relative to the reference shaft, or the same), shaft weight (e.g., lighter or heavier than the reference shaft, or the same), performance versus feel (e.g., more biased toward performance or feel, or neither), etc. Although the shaft characteristics mentioned above may be weighted differently, each of the shaft characteristics may contribute to the performance and/or feel of the reference shaft.

During a fitting session, for example, the individual 140 may take one or more swings with a golf club having the reference shaft to provide the shaft feedback information. In one example, the individual 140 may prefer a shaft with either a softer feel or a more rigid feel than the reference shaft. In another example, the individual 140 may prefer a shaft with a similar or the same feel as the reference shaft but provide either a relatively higher ball flight or a relatively lower ball flight than the reference shaft. Alternatively, the individual 140 may prefer a shaft with either a relatively higher ball flight or a relatively lower ball flight than the reference shaft regardless of the feel of the shaft.

Based on the comparison of the shaft characteristic information of the reference shaft and the plurality of available shafts and/or the shaft feedback information associated with the individual 140, the process 2000 (e.g., via the component option analyzer 260) may identify one or more recommended shafts from the plurality of available shafts (block 2030). Further, the process 2000 (e.g., via the component option analyzer 260) may generate a shaft ranking of the one or more recommended shafts relative to the reference shaft based on the comparison of the shaft characteristic information of the reference shaft and the plurality of available shafts and/or the shaft feedback information associated with the individual 140 (block 2040). In one example, the component option analyzer 260 may identify three (3) recommended shafts from the plurality of available shafts, and generate a shaft ranking of the three recommended shafts in an order according to the shaft feedback information. Accordingly, the individual 140 may select a shaft from the three recommended shafts based on the shaft ranking.

Although the process 2000 may be depicted as a separate process in FIG. 20, the process 2000 may be performed sequentially, concurrently, or simultaneously with other processes associated with the methods, apparatus, systems, and articles of manufactured described herein (e.g., the process 1200 of FIG. 12 and/or the process 1900 of FIG. 19). While a particular order of actions is illustrated in FIG. 20, these actions may be performed in other temporal sequences. For example, two or more actions depicted in FIG. 20 may be performed sequentially, concurrently, or simultaneously. Further, one or more actions depicted in FIG. 20 may not be performed at all. The methods, apparatus, systems, and articles of manufacture described herein are not limited in this regard.

Although certain example methods, apparatus, systems, and/or articles of manufacture have been described herein, the scope of coverage of this disclosure is not limited thereto. On the contrary, this disclosure covers all methods, apparatus, systems, and/or articles of manufacture fairly falling within the scope of the appended claims either literally or under the doctrine of equivalents.

The invention claimed is:

1. A system comprising:

a computerized swing analyzer device configured to:

receive shot characteristic information of an individual; and generate a swing display of a portion of a golf swing at a golf ball with a club head of a golf club by the individual;

wherein:

the swing display presents the golf ball and one or more arrows located about the golf ball, showing a direction of ball rotation of the golf ball such that:

at least a first arrow of the one or more arrows depicts an arcuate first arrow path coplanar with a rotational plane of the golf ball for the direction of ball rotation; and when the rotational plane of the golf ball is non-planar to the swing display, the arcuate first arrow path is shown tilted, along a non-circular arc, to illustrate a non-planar relationship between the rotational plane of the golf ball and the swing display;

the computerized swing analyzer device is configured to generate for the swing display a swing top view of the portion of the golf swing from above the golf ball;

the swing top view is substantially perpendicular to a ground surface;

the swing top view comprises:

a first swing path lane for the club head with respect to the portion of the golf swing; and a first club head representation comprising a first club face indicator for a club face of the club head relative to the first swing path lane;

the first swing path lane comprises:

a heelside lane edgeline for a heel side of the club head, the heelside lane edgeline shown extended along a length of the first swing path lane;

and a toeside lane edgeline for a toe side of the club head, the toeside lane edgeline shown extended along the length of the first swing path lane and shown substantially parallel to the heelside lane edgeline;

the swing top view is configured to present:

a range of target swing path lanes ranging from approximately +20 degrees to approximately −20 degrees relative to a target launch direction with respect to the golf ball; and a range of club face indicators for club face alignments ranging from approximately +20 degrees to approximately −20 degrees relative to the first swing path lane;

the first swing path lane corresponds to at least one of:

a target swing path for the individual, where the range of target swing path lanes comprises the first swing path lane; or an actual swing path traversed by the golf club head for the portion of the golf swing by the individual;

the first club face indicator corresponds to at least one of:

a target club face alignment for the club face of the club head relative to the first swing path lane, where the range of club face indicators comprises the first club face indicator; or an actual club face alignment of the club face of the golf club head for the for the portion of the golf swing by the individual;

the computerized swing analyzer device is configured to generate the swing display such that:

if the individual is right-handed, the first swing path lane at the swing top view is an outside-to-inside swing path lane of less than zero degrees relative to a target launch direction; and if the individual is left-handed, the first swing path lane at the swing top view is an inside-to-outside swing path lane of greater than zero degrees relative to the target launch direction;

the first swing path lane is wider than the first club face indicator; and the computerized swing analyzer device is configured to generate the swing display to:

indicate a slice shot trajectory for the golf ball of the golf swing by the individual if the first swing path lane is an outside-to-inside swing path lane and the first club face indicator is at an open club face alignment of greater than zero degrees relative to the first swing path lane at impact with the golf ball;

indicate a hook shot trajectory for the golf ball of the golf swing by the individual if the first swing path lane is an outside-to-inside swing path lane and the first club face indicator is at a closed club face alignment of less than zero degrees relative to the first swing path lane at impact with the golf ball;

and indicate an inline shot trajectory for the golf ball of the golf swing by the individual if the first swing path lane is an outside-to-inside swing path lane and the first club face indicator is at a squared club face alignment of approximately zero degrees relative to the first swing path lane at impact with the golf ball.

2. A method comprising:

receiving, with a computerized swing analyzer device, shot characteristic information of an individual; and generating, with the computerized swing analyzer device, a swing display of a portion of a golf swing at a golf ball with a club head of a golf club by the individual;

wherein:

the swing display is configured to present the golf ball and one or more arrows located about the golf ball, showing a direction of ball rotation of the golf ball such that:

at least a first arrow of the one or more arrows depicts an arcuate first arrow path coplanar with a rotational plane of the golf ball for the direction of ball rotation; and when the rotational plane of the golf ball is non-planar to the swing display, the arcuate first arrow path is shown tilted, along a non-circular arc, to illustrate a non-planar relationship between the rotational plane of the golf ball and the swing display;

the computerized swing analyzer device is configured to generate for the swing display a swing top view of the portion of the golf swing from above the golf ball;

the swing top view is substantially perpendicular to a ground surface;

the swing top view comprises:

a first swing path lane for the club head with respect to the portion of the golf swing; and a first club head representation comprising a first club face indicator for a club face of the club head relative to the first swing path lane;

the first swing path lane comprises:

a heelside lane edgeline for a heel side of the club head, the heelside lane edgeline shown extended along a length of the first swing path lane;

and a toeside lane edgeline for a toe side of the club head, the toeside lane edgeline shown extended along the length of the first swing path lane and shown substantially parallel to the heelside lane edgeline;

the swing top view is configured to present:

a range of target swing path lanes ranging from approximately +20 degrees to approximately −20 degrees relative to a target launch direction with respect to the golf ball; and a range of club face indicators for club face alignments ranging from approximately +20 degrees to approximately −20 degrees relative to the first swing path lane;

the first swing path lane corresponds to at least one of:

a target swing path for the individual, where the range of target swing path lanes comprises the first swing path lane; or an actual swing path traversed by the golf club head for the portion of the golf swing by the individual;

the first club face indicator corresponds to at least one of:

a target club face alignment for the club face of the club head relative to the first swing path lane, where the range of club face indicators comprises the first club face indicator; or an actual club face alignment of the club face of the golf club head for the for the portion of the golf swing by the individual;

the computerized swing analyzer device is configured to generate the swing display such that:

if the individual is right-handed, the first swing path lane at the swing top view is an outside-to-inside swing path lane of less than zero degrees relative to a target launch direction; and if the individual is left-handed, the first swing path lane at the swing top view is an inside-to-outside swing path lane of greater than zero degrees relative to the target launch direction;

the first swing path lane is wider than the first club face indicator; and the computerized swing analyzer device is configured to generate the swing display to:

indicate a slice shot trajectory for the golf ball of the golf swing by the individual if the first swing path lane is an outside-to-inside swing path lane and the first club face indicator is at an open club face alignment of greater than zero degrees relative to the first swing path lane at impact with the golf ball;

indicate a hook shot trajectory for the golf ball of the golf swing by the individual if the first swing path lane is an outside-to-inside swing path lane and the first club face indicator is at a closed club face alignment of less than zero degrees relative to the first swing path lane at impact with the golf ball;

and indicate an inline shot trajectory for the golf ball of the golf swing by the individual if the first swing path lane is an outside-to-inside swing path lane and the first club face indicator is at a squared club face alignment of approximately zero degrees relative to the first swing path lane at impact with the golf ball.

* * * * *